United States Patent [19]
Muramatsu et al.
[11] 4,069,983
[45] Jan. 24, 1978

[54] METHOD AND DEVICE FOR FORMING A BUNCH WINDING ON A FRESH BOBBIN AT THE TIME OF A DOFFING AND DONNING OPERATION

[75] Inventors: Masahiro Muramatsu; Katsutoshi Taniguchi; Katsuhiko Murase, all of Matsuyama, Japan

[73] Assignee: Teijin Limited, Osaka, Japan

[21] Appl. No.: 676,869

[22] Filed: Apr. 14, 1976

[30] Foreign Application Priority Data

| | | |
|---|---|---|
| Apr. 17, 1975 | Japan | 50-45790 |
| May 6, 1975 | Japan | 50-53124 |
| May 6, 1975 | Japan | 50-53125 |
| June 17, 1975 | Japan | 50-72743 |

[51] Int. Cl.[2] ..... B65H 54/02
[52] U.S. Cl. ..... 242/18 PW; 242/35.5 A; 242/41
[58] Field of Search ..... 242/18 PW, 18 R, 18 DD, 242/18 A, 35.5 R, 35.5 A, 41

[56] References Cited

U.S. PATENT DOCUMENTS

| | | | |
|---|---|---|---|
| 3,559,903 | 2/1971 | McDermott et al. | 242/18 PW |
| 3,762,661 | 10/1973 | Lucke | 242/41 X |
| 3,777,996 | 12/1973 | Torii | 242/18 PW X |
| 3,801,030 | 4/1974 | Kobatake et al. | 242/18 R |
| 3,820,730 | 6/1974 | Endo et al. | 242/35.5 R |
| 3,908,918 | 9/1975 | Bergstrom | 242/18 R |
| 3,948,452 | 4/1976 | Burysek et al. | 242/18 PW |
| 3,971,517 | 7/1976 | Matuura et al. | 242/18 R |

FOREIGN PATENT DOCUMENTS

| | | | |
|---|---|---|---|
| 2,312,609 | 10/1974 | Germany | 242/18 PW |

*Primary Examiner*—Stanley N. Gilreath
*Attorney, Agent, or Firm*—Burgess, Ryan and Wayne

[57] ABSTRACT

After doffing a full size yarn package from a bobbin holder of a takeup apparatus, a fresh bobbin is mounted thereon. A supplying thread via a thread guide is then sucked into an aspirator disposed adjacent to the takeup unit. Next, a portion of the thread upstream from the aspirator is caught by a cut-out groove at a free end of the bobbin holder and a helical winding is formed from the groove to a position on the fresh bobbin where the distance from the thread guide is minimum, and an initial bunch winding is formed at this position. Thereafter, the helical winding is eliminated by forming an additional bunch winding from a part thereof while the remaining part is sucked into the aspirator.

The above method is applied to a takeup unit with a bobbin holder capable of mounting a plurality of bobbins so as to simultaneously form yarn packages from continuously supplied supplying threads. The bunch winding forming operation is carried out separately and sequentially from a bobbin furthest from the free end of the bobbin holder and, after a bunch winding is formed on each of the fresh bobbins all supplying threads are simultaneously introduced into respective traverse guides and normal takeup operation of the takeup unit is commenced.

19 Claims, 66 Drawing Figures

METHOD AND DEVICE FOR FORMING A BUNCH WINDING ON A FRESH BOBBIN AT THE TIME OF A DOFFING AND DONNING OPERATION

SUMMARY OF THE INVENTION

The present invention relates to a method and device for forming a bunch winding on a fresh bobbin at the time of a doffing and donning operation and, more particularly, relates to a method and device for forming a bunch winding on a fresh bobbin or on each of a plurality of fresh bobbins mounted on a bobbin holder of a takeup unit at the time of a doffing and donning operation.

It is well-known that, in the takeup unit provided with a bobbin holder rotatably mounted on the driving mechanism thereof is such a way that one end of the bobbin holder is free, when it is required to form a bunch winding on a fresh bobbin mounted on the bobbin holder, a supplying thread is firstly caught by a cut-out groove formed at the free end of the bobbin holder or the fresh bobbin. Thereafter the introducing point of the supplying thread onto the fresh bobbin is displaced to the region of the traverse motion of a traverse guide. The thread portion held by the cut-out groove is then cut at a time simultaneous with the commencement of the formation of the bunch winding on the fresh bobbin or the commencement of the traverse motion of the supplying thread. Such bunch winding forming method is well suited for application to a takeup unit for taking up a synthetic thread on a fresh bobbin mounted on the above-mentioned bobbin holder.

However, in the above-mentioned bunch winding forming method, there are some drawbacks. For example, since a helical winding is formed on the fresh bobbin when the introducing point of the supplying thread onto the fresh bobbin is displaced from the cut-out groove of the bobbin holder to the region of the traverse motion of the traverse guide, such helical winding remains on the fresh bobbin at a position outside of the bunch winding and, consequently, this helical winding disturbs the smooth running of the thread from the eventual full yarn package mounted on the bobbin to a successive process such as a drawing process. Also, there is a possibility that such a helical winding will become entangled with the above-mentioned running thread, so that the running thread is broken and the quality of the thread is degraded. There is the possiblity that the above-mentioned helical winding will be held by the first yarn layer formed on the fresh bobbin at the time of commencing the normal takeup motion of the takeup unit. However, even if such holding action does occur, there is the possibility that a part of the helical winding will be projected radially from the first layer of the thread of the yarn package when the unwinding of the thread from the yarn package is carried out. In such a case, the possibility also exists that the radially projecting part of the helical winding will cause the breakage of the thread unwound from the yarn package, due to the entanglement of the projected thread with the unwinding thread.

The principal object of the present invention is to provide a method and device for forming a bunch winding on a fresh bobbin without any of the potential drawbacks mentioned above, at the time of carrying out the doffing and donning operation.

To attain the principal object of the present invention, after introducing a supplying thread coming from a thread guide to an aspirator disposed at a position outside of the traverse motion of a traverse guide of a takeup unit, the portion of the supplying thread between the thread guide and the aspirator is caught by a cut-out groove formed at a free end of a bobbin holder or a free end of a fresh bobbin mounted on the bobbin holder; thereafter, the introducing point of the supplying thread onto the fresh bobbin is displaced to a particular position within the region of the traverse motion of the thread, while the above-mentioned thread portion is held by the above-mentioned cut-out groove, so that a helical winding is firstly formed from the cut-out groove to the particular position, and; then, a bunch winding is formed on the fresh bobbin at the particular position. Thereafter, the above-mentioned helical winding is eliminated. For example, the holding of the above-mentioned thread portion by the cut-out groove is released after the bunch winding is firmly formed on the fresh bobbin, so that the helical winding is unwound by the rotation of the bobbin holder and the unwinding portion of the helical winding is continuously sucked into the aspirator. In this case, when the unwinding of the helical winding is completed, the bunch winding is connected to the aspirator by a final part of the unwound helical winding, and this connected thread portion is broken when the thread tension is increased excessively by the further rotation of the bobbin holder. Accordingly, one part of the broken thread is sucked into the aspirator while the other part of the broken thread is held on the previously formed bunch winding by an additionally formed bunch winding. Another example is where, instead of the release of the thread portion held by the cut-out groove, this thread portion is cut by a sharp knife edge of the cut-out groove or broken by increasing the tension thereof, and; then, one part of the broken thread is sucked into the aspirator, while the other part of the broken thread, which is connected to the helical winding, is eliminated by the automatic displacement of the helical winding. This displacement, which is caused by the loosening of the helical winding due to the centrifugal force thereof, is toward the bunch winding, and; after the displacement is completed, the thread from the helical winding is held on the previously formed bunch winding by an additionally formed bunch winding on the fresh bobbin.

It is well-known that, in the above-mentioned conventional takeup device, provided with a pair of traverse guides actuated by a common traverse box and a single bobbin holder provided with a free end, wherein a pair of yarn packages are doffed from and a pair of fresh bobbins are mounted on the bobbin holder, the bunch winding forming operation is simultaneously carried out for each fresh bobbin mounted on the single bobbin holder. However, if such simultaneous formation of the bunch windings on the respective fresh bobbins mounted on an identical bobbin holder is carried out, since a portion of each supplying thread to the respective fresh bobbins is sucked into an aspirator, each of the supplying threads extend from the aspirator to the respective introducing points on the respective fresh bobbbins for forming the corresponding bunch winding on each fresh bobbin. Consequently, the thread portion between the aspirator and the fresh bobbin mounted on an inside position of the bobbin holder from the free end thereof is caught on the fresh bobbin mounted on a position outside the mounting position of the above-mentioned fresh bobbin by the supplying thread forming the bunch winding on the latter fresh bobbin. Therefore, before supplying the yarn packages to the successive process such as a drawing process, it is essential to cut the above-mentioned thread portion connecting two yarn packages formed on the identical single bobbin holder. Further, the possibility exists that the broken end of the above-mentioned thread portion connecting two yarn packages will cause problems similar to those hereinbefore discussed in connection with the basic method for forming the bunch winding on a fresh bobbin according to the present invention.

Consequently, a further object of the present invention is to eliminate the above-mentioned drawbacks of the conventional takeup unit provided with a single bobbin holder and a plurality of traverse guides for simultaneously forming the same number of yarn packages as the traverse guides, on the respective fresh bobbins mounted on the single bobbin holder.

This latter object of the present invention is attained by application of the above-mentioned basic method with certain modifications. That is, the forming of the bunch windings on the respective fresh bobbins mounted on the single bobbin holder is carried out in steps starting with the forming of the bunch winding on the fresh bobbin mounted on the bobbin holder at a position furthest from the free end of the bobbin holder, and; when forming the bunch winding on each fresh bobbin, the above-mentioned basic method for forming the bunch winding on a fresh bobbin is applied. While carrrying out the stepwise formation of the bunch windings on the respective spindles, it is important to separate the thread portions of the supplying threads, which are introduced into a aspirator, in such a way that only one of the above-mentioned thread portions is introduced to a cut-out groove formed at a free end of the bobbin holder, so as to form a bunch winding on a corresponding fresh bobbin, while the other of the above-mentioned thread portions are held at respective positions free from engagement with the above-mentioned cut-out groove. A still further purpose of the present invention is to provide a bunch winding forming device which is applicable for the conventional takeup machine provided with a plurality of takeup units, each unit being provided with a plurality of traverse guides actuated by a common traverse box and a single bobbin holder for mounting a plurality of fresh bobbins at respective positions facing the corresponding traverse guides, wherein such bunch winding forming device is utilized in cooperation with an automatic doffing and donning apparatus which is capable of displacing along an alignment of the takeup units, and this bunch winding forming device is capable of carrying out the above-mentioned method of forming the bunch winding.

The above-mentioned practical device for forming the bunch winding on the respective fresh bobbins mounted on a single bobbin holder, is provided with a particular means for separately introducing a thread portion of the supplying thread, one end of which is sucked into an aspirator, to a cut-out groove formed at a free end of the bobbin holder, and related elements for forming the bunch winding, a programing control means for operating the essential elements for carrying out the doffing, donning and bunch winding forming operations. The inventors of the present invention have confirmed by repeated tests that the above-mentioned bunch winding forming device is preferably mounted on and cooperates with the automatic doffing and donning apparatus.

For the purpose of providing a clear explanation of the basic method for forming a bunch winding on a fresh bobbin mounted on a takeup machine according to the present invention, an additional device for carrying out such a method, which is utilized for the conventional takeup machine, is first explained.

Figure 1A:
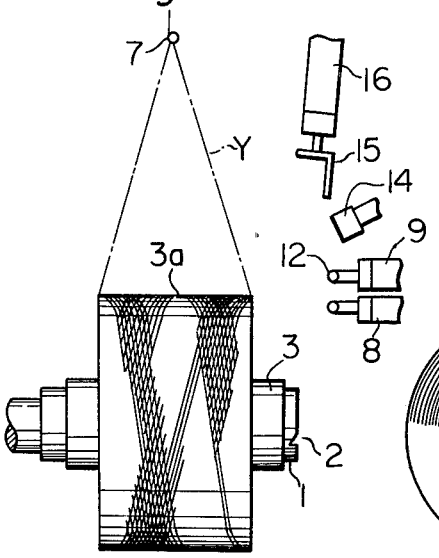
FIGS. 1A and 1B are schematic front and side views, respectively, of the main part of the conventional takeup unit provided with a basic device for forming a bunch winding on a fresh bobbin mounted on the takeup unit, according to the present invention.
Figure 1B:
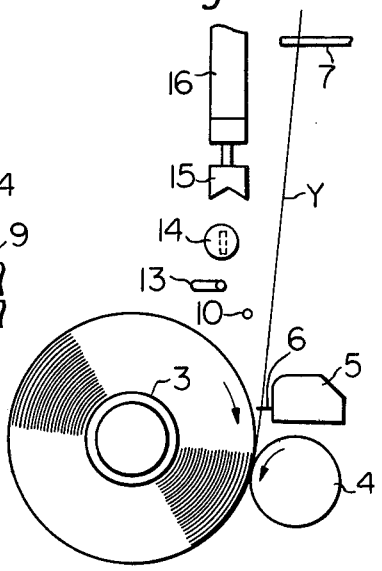

Referring to FIGS. 1A and 1B, a fresh bobbin 3 is mounted on a bobbin holder 1 which is horizontally projected from a machine frame (not shown) of a takeup machine (not shown) in a rotatable condition. The bobbin holder 1 is provided with a cut-out groove 2 formed at a side edge of a free end portion thereof. A sharp knife edge which is capable of cutting a thread is not formed on the cut-out groove 2, because this groove 2 has the single function of temporarily catching a thread. A thread Y is introduced to a traverse guide 6 of a traverse box 5 by way of a yarn guide 7 which corresponds to a starting point of an isosceles triangular locus of the traversing yarn passage. Thereafter, the yarn is taken up on the bobbin 3 by the frictional driving of a friction roller 4 to which the bobbin 3 or a winding yarn package 3*a* is urged.

The above described takeup mechanism is well known as a conventional takeup mechanism. To attain the purpose of the present invention, the following additional members are required. That is, a pair of horizontal pneumatic cylinders 8 and 9 are disposed at a position adjacently above the above-mentioned takeup mechanism as shown in FIGS. 1A and 1B, and a thread takeoff guide 10 is formed on a piston of the pneumatic cylinder 8 as one body while a thread cutting guide 12 is formed on a piston of the pneumatic cylinder 9 as one body. Consequently, these guides 10 and 12 are capable of reciprocally displacing along the axial direction of the bobbin 3 at a position adjacently above the above-mentioned takeup mechanism. The thread takeoff guide 10 is provided with a cut-out portion 11 (FIG. 2A) which is capable of fixing the yarn passage at a predetermined position in a region of the traverse motion of the thread Y. The thread cutting guide 12 is provided with a hook 13 formed at a free end thereof by which the thread Y is forced to displace toward the machine frame (not shown). A pneumatic cylinder 16 is vertically disposed at a position above the pneumatic cylinders 8 and 9, and a thread catching guide 15 is secured to a bottom free end of a piston of the pneumatic cylinder 16. An aspirator 14 is disposed at a position between the pneumatic cylinder 9 and the pneumatic cylinder 16. The relative position of these pneumatic cylinders 9 and 16, and the aspirator 14 is required to satisfy the following condition. That is, after a free end of the thread Y coming from the thread guide 7 is sucked into the aspirator 14, when the pneumatic cylinder 16 is actuated, the thread guide 15 is capable of first catching the yarn Y at a position between the thread guide 7 and the aspirator 14 and then of introducing the thread Y to the cut-out portion 2 of the bobbin holder 3.

The above-mentioned pneumatic cylinders 8, 9 and 16, and the aspirator 14 are preferably disposed on a doffing and donning apparatus, which is capable of displacing along a plurality of takeup units mounted of a takeup machine, at a position adjacently before the takeup units. However, each of these additional elements may be mounted on each of the takeup units or may be mounted partly on each of these takeup units and partly on the above-mentioned doffing and donning apparatus.

By utilizing the above-mentioned bunch winding forming device, the basic method for forming a bunch winding on a fresh bobbin mounted on a takeup unit of a takeup machine is carried out as illustrated in the following detailed explanation, with reference to FIGS. 2A, 2B, 3A, 3B, 4A, 4B, 5A, 5B, 6A, 6B, 7A and 7B.

Figure 2A:
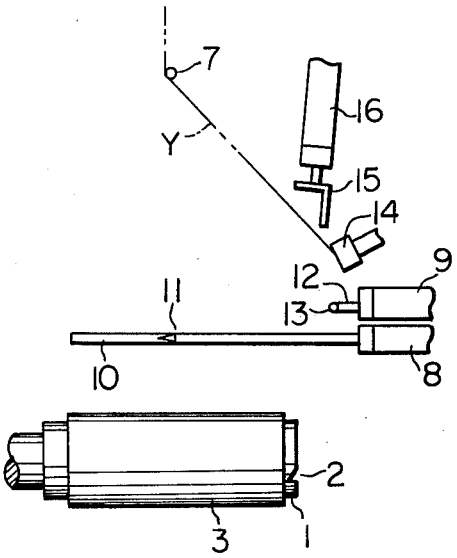
FIGS. 2A, 3A, 4A, 5A and 6A, are schematic front views of a bobbin holder of the takeup unit shown in FIGS. 1A and 1B at sequential steps for forming a bunch winding on a fresh bobbin mounted on the takeup unit according to the present invention.
Figure 2B:
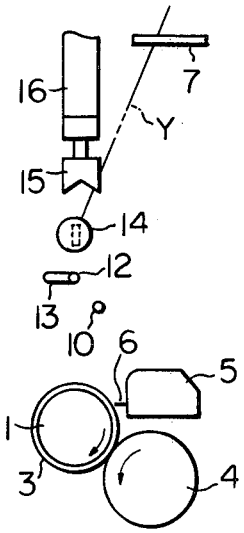
FIGS. 2B, 3B, 4B, 5B and 6B, are schematic side view of a bobbin holder of the takeup unit shown in FIGS. 2A, 3A, 4A, 5A and 6A, respectively.
Figure 3A:
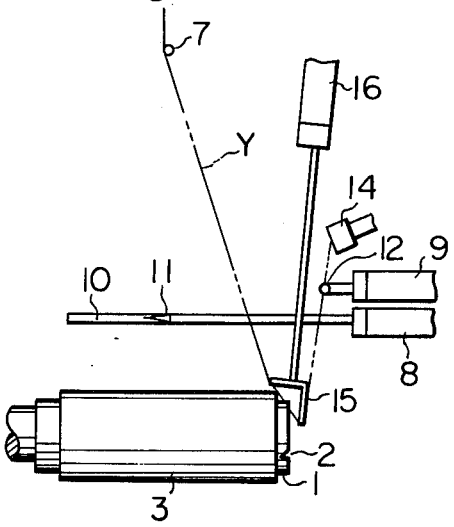
Figure 3B:
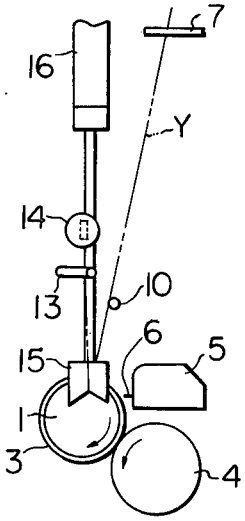

1. Referring to FIGS. 2A and 2B, when the yarn package formed on the bobbin 3 becomes a predetermined full size, the pneumatic cylinder 8 is actuated so as to project the thread takeoff guide 10 and, consequently, a tip portion of the thread takeoff guide 10 displaces the thread Y from the traverse guide 6. Thereafter , the thread Y is introduced to the aspirator 14 by an action of another thread guide (not shown) and cut by a cutter (not shown). According to the above-mentioned motion, the cut free end of the thread Y is sucked into the aspirator 14. Thereafter, the full size yarn package (not shown) is doffed from the bobbin holder 1 and a fresh bobbin 3 is mounted on the bobbin holder 1. This doffing and donning operation may be carried out manually or automatically.

2. Next, referring to FIGS. 3A and 3B, the pneumatic cylinder 16 is actuated so as to displace the thread catching guide 15 downward to a position very close to a free end of the bobbin holder 1. Due to this downward displacement of the guide 15, the thread Y between the thread guide 7 and the aspirator 14 is caught by the cut-out groove 2 of the bobbin holder 1.

Figure 4A:
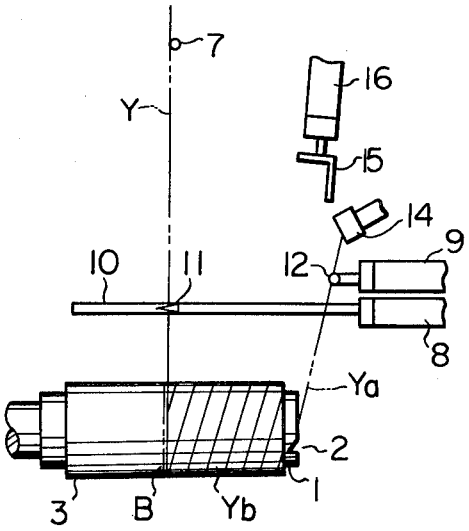
Figure 4B:
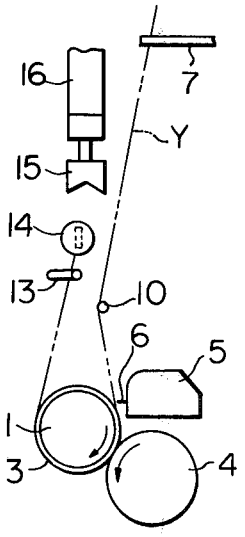

3. Referring to FIGS. 4A nad 4B, during a period of positioning the thread catching guide 15 at the above-mentioned position very close to the free end of the bobbin holder 1, the thread Y coming from the thread guide 7 is forced to wind about the bobbin 3 by the rotation thereof. Since the thread Y between the thread guide 7 and the cut-out groove 2 of the bobbin holder 1 is stretched by the above-mentioned winding, the above-mentioned winding is displaced toward an axial direction of the bobbin 3, which is opposite from the free end of the bobbin holder 1, so as to reduce the tension of the thread Y. Consequently, the distance between the thread guide 7 and a point for introducing the thread Y to the fresh bobbin 3 becomes minimum, in other words, the above-mentioned introducing point reaches a position right below the thread guide 7. As a result, the yarn passage between the thread guide 7 and the fresh bobbin is introduced into the cut-out portion 11 on the thread takeoff guide 10 so that the additional winding of the thread Y on the fresh bobbin 3 is formed at a portion of the fresh bobbin 3 which is restricted by the cut-out portion 11. Such additional winding forms a so-called bunch winding.

Although we have confirmed by experimental tests that the above-mentioned cut-out portion 11 formed on the thread takeoff guide 10 is not essential to form the bunch winding, it is preferable to apply the above-mentioned cut-out portion so as to form the bunch winding in a reliable condition.

Figure 5A:
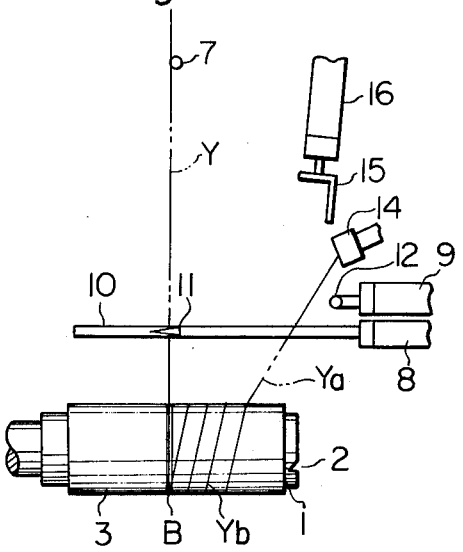
Figure 5B:
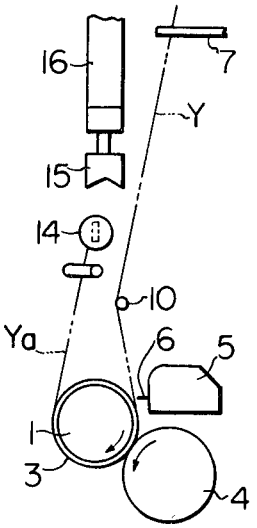

4. Referring to FIGS. 5A and 5B, upon forming the bunch winding on the fresh bobbin 3, the pneumatic cylinder 16 is actuated so as to displace the thread catching guide upward toward its standby position. Due to the above-mentioned upward displacement of the thread catching guide 15, the thread Y is released from the cut-out groove 2 of the bobbin holder 1. That is, upon fixing the thread Y on the fresh bobbin 3 by forming the bunch winding thereon, the thread Y is released from the cut-out groove 2 of the bobbin holder 1 so as to prevent possible breakage of the thread Y by the cut-out groove 2. Due to the rotation of the fresh bobbin 3 in a direction identified by an arrow in the drawings, the winding formed on the fresh bobbin 3 from the free end thereof to the bunch winding is unwound, however, such unwound portion of the thread Y is sucked into the aspirator 14.

Figure 6A:
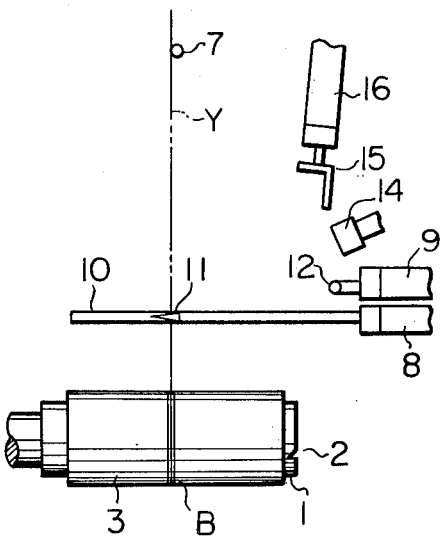
Figure 6B:
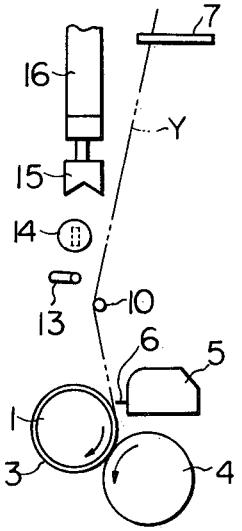
Figure 7A:
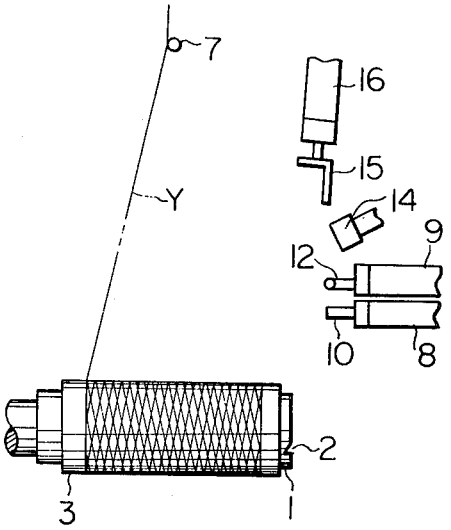
FIGS. 7A and 7B are schematic front and side views, respectively, of a bobbin holder of the takeup unit shown in FIGS. 1A and 1B after completion of the forming of the bunch winding on the fresh bobbin mounted on the takeup unit and the forming of a first winding layer of a thread for forming a yarn package on the bobbin.
Figure 7B:
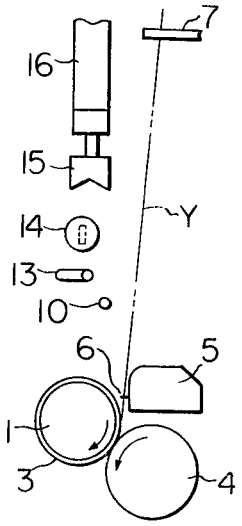

5. Referring to FIGS. 6A and 6B, when the wound portion of the thread Y on the bobbin 3 connected to the bunch wind is unwound, the thread Y between the fixed point of the bunch wind and the aspirator 14 is stretched by the turning motion of the bobbin 3 and the suction force of the aspirator 14 and then the thread Y of this portion is broken. However, the broken end of the thread Y connected to the bunch winding is wound into the additional bunch winding and, consequently, any trouble which might be caused by the free end portion of thread projecting from the bunch winding, which is frequent in the conventional takeup device, can be preferably eliminated. In the above-mentioned operation, the pneumatic cylinder 9 is actuated so as to project the thread cutting guide 12 toward a position above the bobbin holder 1 so as to displace the hook portion 13 thereof to a position close to the cut-out portion 11 of the thread takeoff guide 10. As a result, a portion of the thread Y between the bobbin 3 and the aspirator 14 is displaced to a position right above the bunch winding B and, thereafter, the thread Y is broken. In a modification of the above-mentioned operation, a cutter (not shown) may be used for accurately cutting the thread Y, or the aspirator 14 may be arranged at a position adjacent to a position forming the bunch winding B on the fresh bobbin 3 so as to prevent the possible failure of cutting the thread Y.

6. Next, referring to FIGS. 7A and 7B, the thread cutting guide 12 and the thread takeoff guide 10 are displaced to their standby position by actuating the pneumatic cylinders 9 and 8, respectively, at a time simultaneously with or just after the time of cutting the thread Y between the bunch winding B and the aspirator 14. Thus, the thread Y coming from the thread guide 7 to the bunch winding B is released from the thread takeoff guide 10 and is approached to the traverse box 5. The thread Y is automatically caught by the traverse guide 6 so that the normal traverse motion is imparted to the thread Y coming from the thread guide 7 and, consequently, the normal takeup motion on the fresh bobbin 3 is commenced.

In the above-mentioned embodiment of the present invention, a thread takeoff thread guide 10 having a rod shape, is utilized, however, a thread guide having any other shape but having a function similar to the above described thread guide 10 can be used.

According to the above-mentioned method, the engagement of thread Y with the cut-out groove 2 of the bobbin holder 1 is released at a time simultaneously with or right after the completion of the forming of the bunch winding B on the bobbin 3, and; after the thread Y unwound from the bobbin 3 is sucked into the aspirator 14, the thread Y is broken. Consequently, the possibility of creating a free thread piece projecting from the bunch winding B is perfectly eliminated. Thus, any troubles which might be caused by the winding a free thread piece about the friction roller 4, entanglement of a free thread piece with the supplied thread Y coming from the traverse guide 6, or breakage of the supplied thread Y due to the entanglement of a free thread piece with the supplied thread Y are perfectly eliminated.

Figure 8A:
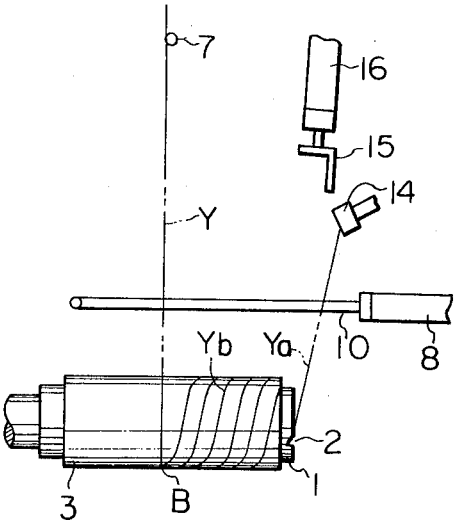
FIGS. 8A and 8B, are schematic front and side views, respectively, of a bobbin holder of the takeup unit shown in FIGS. 1A and 1B showing a modified method for forming the bunch winding on a fresh bobbin mounted on the takeup unit, according to the present invention.
Figure 8B:
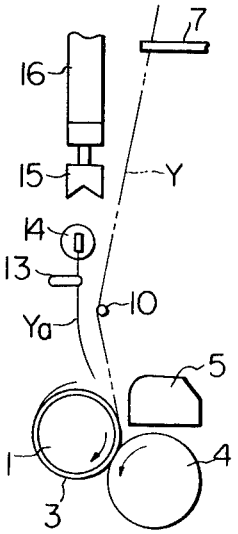
Figure 9A:
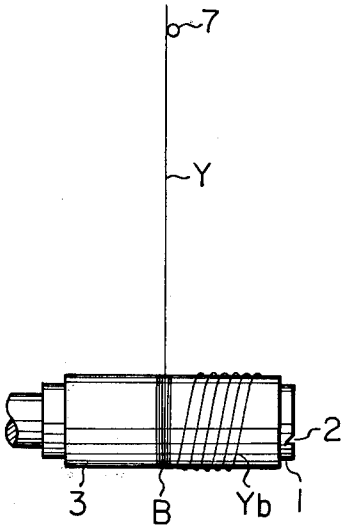
FIGS. 9A and 9B are schematic front views of a bobbin holder of the takeup unit shown in FIGS. 8A and 8B, representing the final two steps of forming the bunch winding on the fresh bobbin, according to the present invention.
Figure 9B:
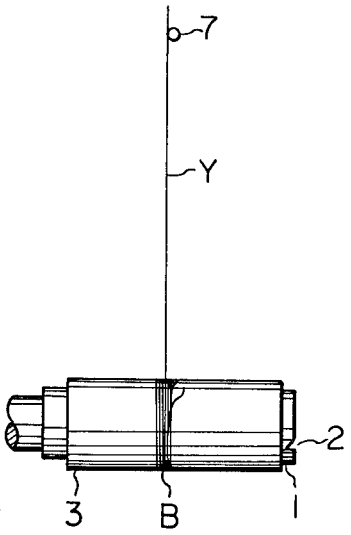

A modification of the above-mentioned basic method is shown in FIGS. 8A and 8B, wherein, after forming the bunch winding on the fresh bobbin 3, the thread Y*a* between the cut-out groove 2 of the bobbin holder 1 and the aspirator is cut by a knife edge portion of the cut-out groove 2 when the bunch winding B is firmly formed on the bobbin 3, because such firm formation of the bunch winding B on the bobbin 3 tighten the spiral winding Y*b* on the bobbin 3 so that the thread Y*a* is strongly urged to the knife edge portion of the cut-out groove 2. When the thread Y*a* is cut by the knife edge of the cut-out groove 2 of the bobbin holder 1, the thread Y*a* is sucked into the aspirator 14, while the diameter of each unit of the helical winding Y*b* tends to expand radially because the centrifugal force thereof created by the rotation of the bobbin 3. Due to the above-mentioned tendency of the helical winding Y*b* to expand radially, the helical winding Y*b* automatically moves toward the bunch winding B as shown in FIG. 9A and finally is wound into the additional bunch winding as shown in FIG. 9B. Since the condition of holding the helical winding Y*b* by the bunch winding, which involves the above-mentioned additional winding, is quite similar to the above-mentioned basic method, the same result as the basic method can be expected.

A practical embodiment of the above-mentioned device applied to a thread making machine is hereinafter explained in detail with reference to FIGS. 10A and 10B. In this embodiment, the principle of forming a bunch winding on a fresh bobbin corresponding to the modified method shown in FIGS. 8A, 8B, 9A and 9B is applied. In the following explanation concerning the modified embodiment according to the present invention, machine elements having functions similar to the elements shown in FIGS. 1A to 9B are represented by identical reference numerals for ease in understanding the present invention.

Figure 10A:
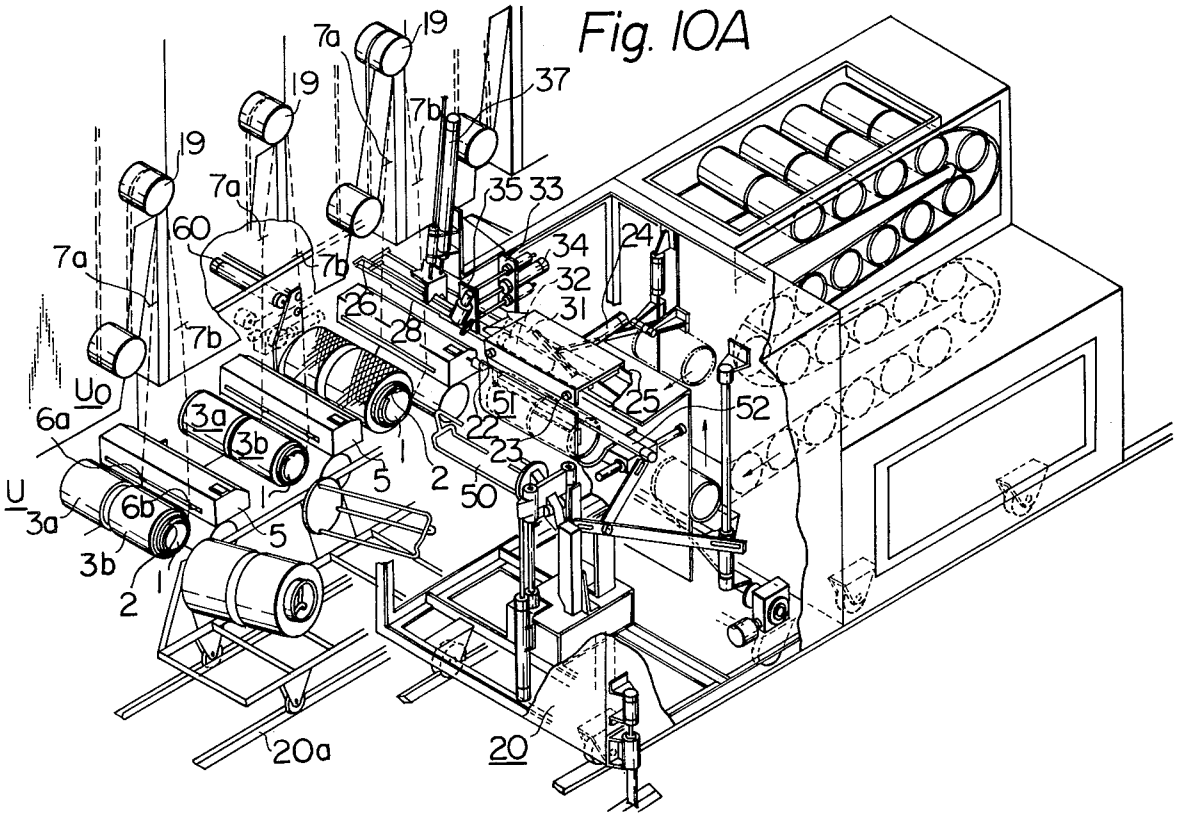
FIGS. 10A is a perspective view of a main part of an automatic doffing and donning apparatus provided with a bunch winding forming device according to the present invention, which is utilized for a conventional takeup machine provided with a plurality of takeup units.
Figure 10B:
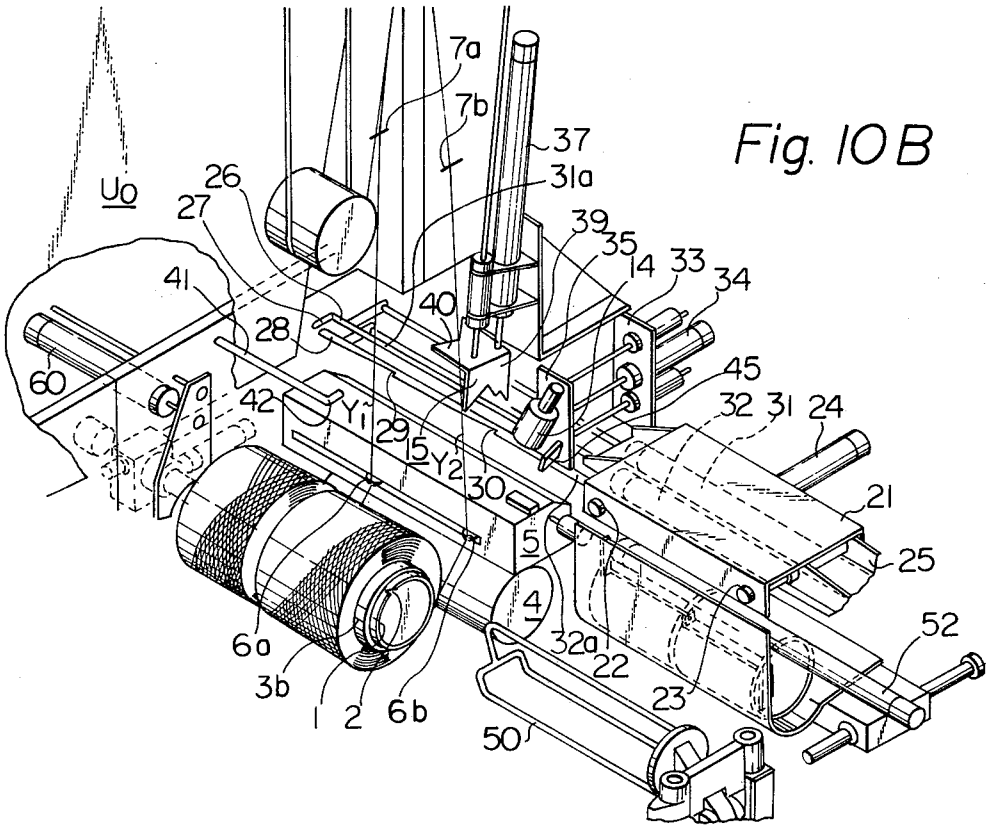
FIGS. 10B is an enlarged perspective view of the bunch forming device together with a main part of the automatic doffing and donning apparatus shown in FIG. 10A.

In the embodiment shown in FIGS. 10A and 10B, the takeup machine is provided with a plurality of takeup units U mounted on a machine frame $U_0$, in alignment. Each takeup unit U is provided with a rotatable friction roller 4 horizontally projected outward from the machine frame $U_O$, a traverse box 5 disposed at a position right above the friction roller 4 and a bobbin holder 1 rotatably supported by a swing bracket (not shown) in such a condition that the bobbin holder 1 is capable of contacting with the friction roller 4 under a pertinent contact pressure. The traverse box 5, friction roller 4 bobbin holder 1 are arranged in parallel and facing condition. The traverse box 5 is provided with a pair of traverse guides 6a, 6b which create the traverse motion of threads $Y_1$ and $Y_2$ supplied from a goded roller 19 via the respective stationary thread guides 7a and 7b, so as to form a package on the corresponding bobbins 3a, 3b mounted on the bobbin holder 1. It is understood that the above described takeup unit is well known as a conventional one.

The bobbin holder 1 is provided with a cut-out groove 2 formed at a free end thereof. This cut-out groove works to catch a thread so as to form a bunch winding first on the fresh bobbin 3a and second on the fresh bobbin 3b independently from the bunch winding formed on the fresh bobbin 3a. It is also applicable, for forming the above-mentioned bunch winding on the respective fresh bobbins, that a cut-out groove is formed on the free side of each of the two bobbins because a cut-out groove on the free side of a fresh bobbin mounted on a bobbin holder is capable of catching a thread in a similar manner to the above-mentioned cut-out groove 2.

In this embodiment an automatic doffing and donning apparatus 20 is utilized for carrying out the doffing and donning operation automatically, and also for automatically forming the bunch winding on each of the fresh bobbins 3a, 3b mounted on the bobbin holder 1. The automatic doffing and donning apparatus 20 is capable of displacing to a position in front of the alignment of the takeup units U of the takeup machine along carrier rails 20a disposed at a position in front of the takeup units in parallel condition to the alignment of the takeup units. The automatic doffing and donning apparatus 20 is capable of stopping at a predetermined position in front of a takeup unit U which requires the doffing of a pair of full size yarn packages from a bobbin holder 1 thereof, so as to doff the full size packages and mount a pair of fresh bobbins 3a, 3b on the bobbin holder 1. A device for forming the bunch winding on each of the fresh bobbins 3a, 3b on the bobbin holder 1 is mounted on the automatic doffing and donning apparatus 20. The sequential motions of the automatic doffing and donning operation and the automatic forming of the bunch winding on the fresh bobbins 3a, 3b are controlled by a programing control mechanism mounted on the doffing and donning apparatus 20.

The bunch winding forming device is provided with a supporting frame 25 which is slidably mounted on a pair of horizontal shafts 22, 23 rigidly mounted on a frame 21 of the apparatus 20. The supporting frame 25 is capable of reciprocally displacing toward a direction parallel to the alignment of the takeup units U by means of a pneumatic cylinder 24. A pair of pneumatic cylinders 31 and 32 are rigidly mounted on the supporting frame 25 in such a condition that these pneumatic cylinders 31 and 32 are arranged horizontally, in parallel condition, in a direction perpendicular to the alignment of the takeup units. The pneumatic cylinder 31 is disposed at a position adjacently above the pneumatic cylinder 32. A thread catching guide 26 is formed on a piston rod 31a of the pneumatic cylinder 31 while a thread takeoff guide 28 is formed on a piston rod 32a of the pneumatic cylinder 32. The thread catching guide 26 is provided with a hook 27, while the thread takeoff guide 28 is provided with a pair of cut-out portions 29 and 30 which work to introduce the respective winding threads to the central portion of the corresponding bobbins 3a and 3b at the time of forming the bunch winding or completing the formation of a full size yarn package. A supporting frame 33 is rigidly mounted on, so as to project upward from the supporting frame 25 in a space between the machine frame $U_0$ and the frame 25. A supporting plate 35 is rigidly mounted on a pneumatic cylinder 34 horizontally secured to the support frame 33 in such a way that the supporting plate 35 is capable of reciprocally displacing along a direction parallel to the alignment of the takeup units U. An aspirator 14 and a cutter 45 are mounted on the supporting plate 35 as particularly shown in FIG. 10B. The aspirator 14 and a cutter 37 are capable of projecting from the supporting plate 35. A pneumatic cylinder 37 is vertically disposed at a position adjacent to the position occupied by the aspirator 14 at the time of projecting, and a thread holding guide 15 is secured to a free end of a piston rod of the pneumatic cylinder 37. The thread holding guide 15 comprises a vertical guide plate 39 and a horizontal plate 40 projected toward the machine frame $U_0$. The vertical guide plate 39 is provided with a pair of cut-out edges 39a and 39b (see FIG. 16B) arranged at different levels in such a condition that the cut-out edge 39a is positioned at a lower level than the cut-out edge 39b. The cut-out edge 39b guides a thread $Y_1$ which is introduced to the fresh bobbin 3a while the cut-out edge 39b guides the thread $Y_2$ which is introduced to the fresh bobbin 3b. The horizontal plate 40 may be omitted. A horizontal thread guide 41 is perpendicularly projected from the machine frame $U_0$ in a parallel condition to the bobbin holder 1. The thread guide 41 is provided with a hook 42 horizontally projected from a free end portion thereof in such a condition that the hook 42 occupies a position in a space between the bobbin holder 1 and a thread guide 7a and a space of the traverse motion of the traverse guide 6a.

Next, the automatic doffing and donning operation together with the automatic forming of the bunch winding on the corresponding fresh bobbin by means of the above-mentioned apparatus is hereinafter explained with reference to the attached drawing from FIG. 11A to FIG. 19B. The above-mentioned automatic doffing and donning apparatus and the operation thereof are disclosed in detail by the Japanese laid open specification Sho 51(1976)-29545, patent application Sho 49(1974)-101321, and therefore, the detailed explanation thereof is omitted in the following explanation.

The doffing and donning operation, and also the bunch winding formation by means of the automatic apparatus shown in FIGS. 10A and 10B are carried out by the following steps.

Figure 11A:
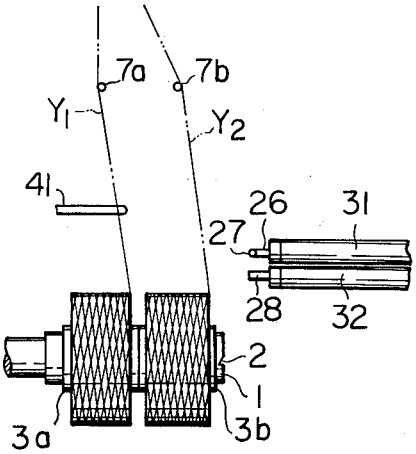
FIGS. 11A, 12A, 13A, 14A, 15A, 16A, 17A, 18A and 19A are schematic front views of a bobbin holder of the takeup unit and the bunch winding forming device shown in FIG. 10A, which represent sequential steps for a doffing, donning and bunch winding forming operation according to the present invention.
Figure 11B:
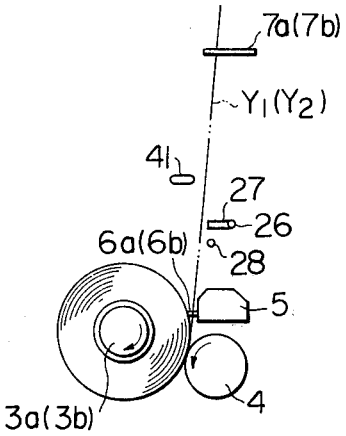
FIGS. 11B, 12B, 13B, 14B, 15B, 16B, 17B, 18B and 19B are schematic side views corresponding to FIGS. 11A, 12A, 13A, 14A, 15A, 16A, 17A, 18A and 19A, respectively.
Figure 12A:
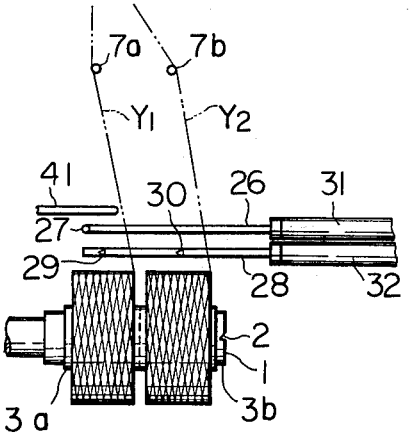
Figure 12B:
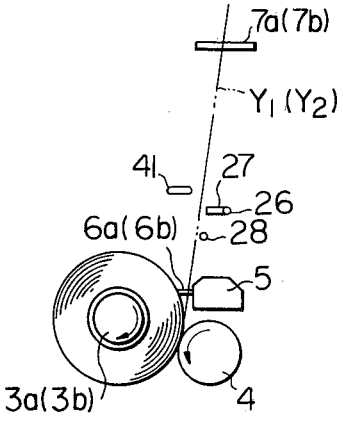

1. When the automatic doffing and donning apparatus 20 is stopped at a predetermined working position facing a takeup unit wherein it is required to doff a pair of full size yarn packages and to mount a pair of bobbins 3a and 3b on the bobbin holder 1, the thread guide 26 and the thread takeoff guide 28 are located at the respective positions away from the free side of the traverse box 5 on higher level than the box 5 as shown in FIGS. 11A and 11B.

2. The pneumatic cylinders 31 and 32 are then actuated so as to project the respective piston rods outward and, consequently, the thread guides 26 and 28 are displaced to the respective positions above the traverse box 5 shown in FIGS. 12A and 12B.

Figure 13A:
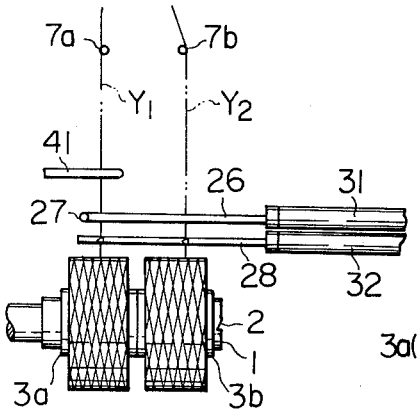
Figure 13B:
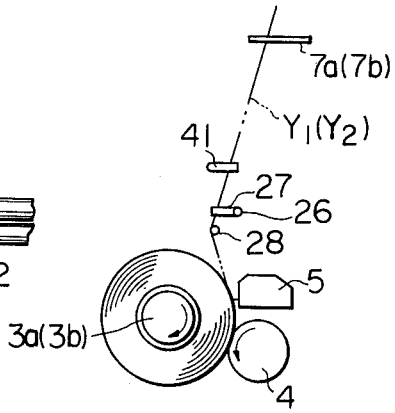

3. Next, the pneumatic cylinder 24 is actuated so that the supporting frame 25 is displaced forward along the carrying passage of the apparatus 20. According to this displacement of the supporting frame 25, the thread guides 26 and 28 are displaced from the respective position above the traverse box 5 shown in FIGS. 12A and 12B to respective positions above a position where a fresh bobbin held by a bobbin holder 1 is positioned when the bunch winding is formed on the fresh bobbin. According to the above-mentioned displacement of the thread guides 26, 28, the threads $Y_1$ and $Y_2$, which are being taken up on the respective yarn packages formed on the bobbins *3a*, *3b* via the respective traverse guides *6a*, *6b*, are contacted with the thread takeoff guide 28 so that these threads $Y_1$, $Y_2$ are taken off from the respective traverse guides *6a*, *6b*. Consequently, the threads $Y_1$, $Y_2$, which are coming from the respective thread guides *7a*, *7b*, are led to the central portion of the corresponding traverse zone and are introduced into the respective cut-out portions 29, 30 of the thread guide 28 as shown in FIGS. 13A and 13B. Since the hook 42 of the thread guide 41 is located at a position closer to the automatic doffing and donning apparatus 20 than the traverse zone of the traverse guide *6a*, the thread $Y_1$ is running at a position closer to the machine from $U_0$ than the hook 42 of the thread guide 41, in the above-mentioned situation.

Figure 14A:
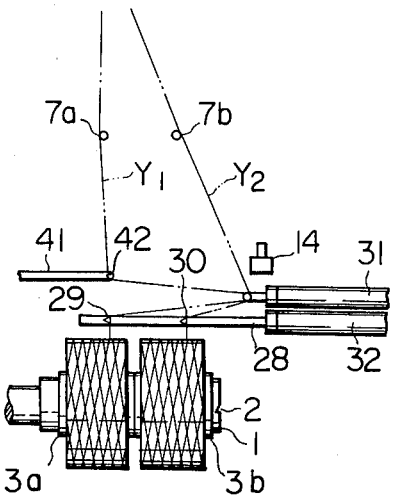
Figure 14B:
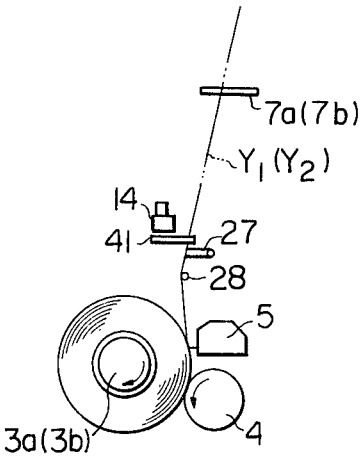

4. As shown in FIGS. 14A and 14B, when the thread guide 26 is displaced toward the pneumatic cylinder 31, the thread $Y_1$ is caught by the hook 27 of the thread guide 26 and is deflected against the hook 42 and then to a position right below the aspirator 14 and the cutter 45. In this situation, the supporting plate 35 (FIGS. 10A and 10B) has been displaced to a position above and in front of the pneumatic cylinder 31 shown in FIGS. 14A and 14B. Since the cutter 45 is disposed very close to the aspirator 14, the cutter 45 is not shown in FIGS. 14A and 14B.

Figure 15A:
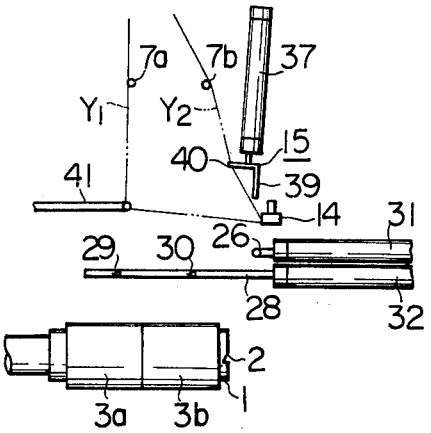
Figure 15B:
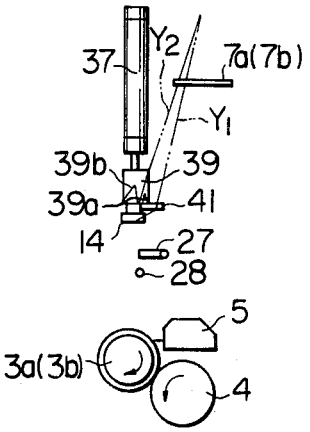

When the threads $Y_1$ and $Y_2$ are cut by the cutter 45, these threads $Y_1$ and $Y_2$ are sucked into the aspirator 14. In this condition, the full size yarn packages are doffed from the bobbin holder 1 and a pair of fresh bobbins *3a*, *3b* are automatically mounted on the bobbin holder 1 by the automatic doffing and donning apparatus 20. In this above-mentioned condition, since the thread $Y_1$ which is running along a thread passage toward an inside fresh bobbin *3a* is restricted in its free displacement toward the aspirator 14 by the hook 42 of the thread guide 41, the passages of the threads $Y_1$, $Y_2$ are separated as shown in FIGS. 15A and 15B.

The above-mentioned doffing and donning operations are carried out as briefly explained hereinafter. That is, when it is required to doff the full size yarn packages from the bobbin holder 1, these yarn packages are pushed out from the bobbin holder 1 to a peg 50 (FIG. 10A) of the apparatus 20 by actuating a pneumatic cylinder (or pusher) 60. Thereafter the peg 50 holding the doffed yarn packages is displaced downward. Next, a supply member 51 holding a pair of fresh bobbins *3a*, *3b* is displaced to a position correctly facing the bobbin holder 1, and a pneumatic cylinder (or pusher) 52 is actuated so as to push the fresh bobbins *3a*, *3b* onto the bobbin holder 1. According to the above-mentioned motion, the fresh bobbins *3a*, *3b* are correctly mounted on the bobbin holder 1. However, to attain the purpose of the present invention, other doffing and donning methods and apparatus can be applied.

5. After completion of the above-mentioned donning operation, the driving speed of the friction roller 4 is increased and when the rotation speed of the fresh bobbins *3a*, *3b* reaches a predetermined speed, the pneumatic cylinder 37 is actuated so as to descend the thread holding guide 15 to a position very close to the free end of the bobbin holder 1. According to the above-mentioned descending motion of the thread holding guide 15, the threads $Y_1$ and $Y_2$ which are being sucked into the aspirator 14 are caught by the guide 15 in such a condition that the thread $Y_1$ is introduced to the cut-out edge 39*a* of the vertical guide plate 39 while the thread $Y_2$ is introduced to the cut-out edge 39*b* of the guide plate 39, as shown in FIGS. 16A and 16B.

Figure 17A:
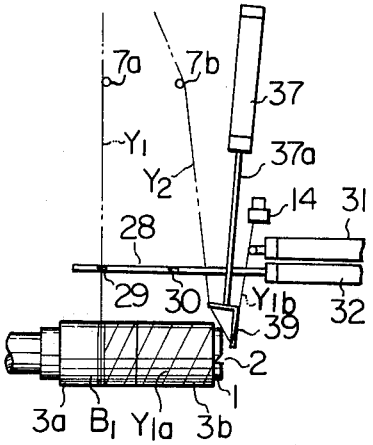
Figure 17B:
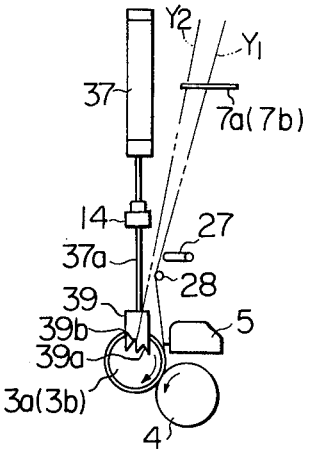

Since the thread $Y_1$ is introduced to the cut-out edge 39*a* of the guide plate 39 via the thread guide 41, the thread $Y_1$ passes below the passage of the thread $Y_2$ which is introduced from the thread guide *7b* directly to the cut-out edge 39*b*. Consequently, as shown in FIGS. 17A and 17B, if the descending motion of the thread holding guide 15 is stopped at a position where the thread $Y_2$ contacts the free end of the bobbin holder 1, the thread $Y_1$ is caught by the cut-out groove 2 of the bobbin holder 1, and helical winding $Y_{1a}$ of the thread $Y_1$ is first formed on the fresh bobbin *3b*. This is because, the introducing point of the thread $Y_1$ to the fresh bobbin *3b* tends to move toward a particular point, where the distance between the thread guide *7a* and the bobbin holder 1, is minimum so as to be able to reduce the thread tension.

Figure 16A:
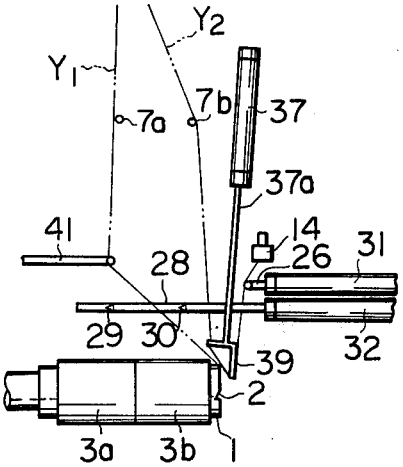
Figure 16B:
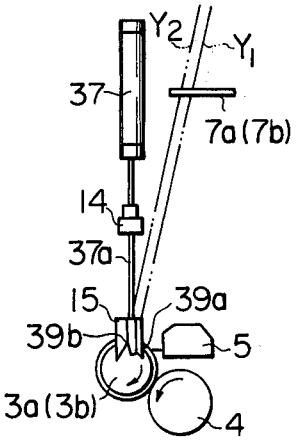

Concerning the method for introducing the threads $Y_1$ and $Y_2$ to the cut-out grooves 39*a* and 39*b*, respectively, in separate condition, the following methods can be applied. That is:

a. the level of the thread guide 41 is fixed at a position below the level of the thread guide *7b* so as to change the angle of the thread $Y_1$ with respect to the horizontal plane, at the introducing point of the aspirator 14, from that of the thread $Y_2$, and then the thread holding guide 15 is displaced vertically downward, as shown in FIG. 16A, or;

b. the difference in level between the position of the thread guide 41 and the thread guide *7b* is a described above and these thread guides 41 and *7b* are arranged on an indentical vertical plane which is parallel to the bobbin holder 1, the thread holding guide 15 is displaced along a passage inclined to the above-mentioned vertical plane so as to introduce the threads $Y_1$, $Y_2$ into the cut-out edges 39*a*, 39*b*, respectively, in separate condition, or;

c. the combination of the above-mentioned methods (*a*) and (*b*).

Figure 18A:
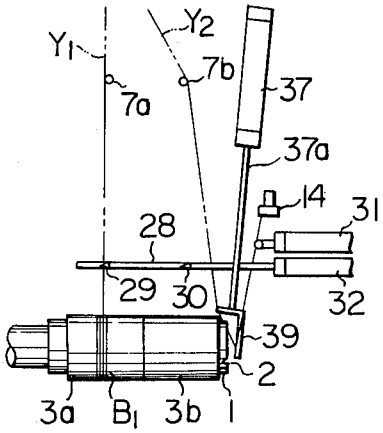
Figure 18B:
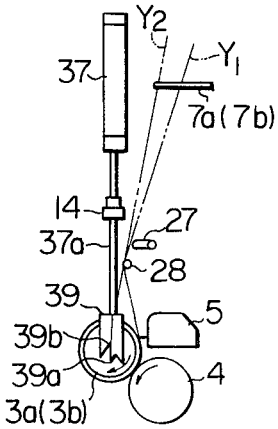

Since the above-mentioned particular point concerning the thread $Y_1$ is located on the fresh bobbin *3a*, the above-mentioned helical winding $Y_{1a}$ is continuously formed until the introducing point comes to the above-mentioned particular point on the fresh bobbin *3a* and, finally, the bunch winding is formed on the fresh bobbin *3a* at a portion involving the above-mentioned particular point. In the above-mentioned formation of the bunch winding on the fresh bobbin *3a*, even if the engagement of the thread $Y_1$ to the cut-out groove 2 of the bobbin holder 1 is released, the thread $Y_1$ is again caught by the cut-out groove 2. Referring again to FIGS. 17A and 17B, when the bunch winding $B_1$ is firmly formed on the fresh bobbin *3a*, the helical winding $Y_{1a}$ is tightened on the bobbin *3a* because of the elevation of the yarn tension of the helical winding $Y_{1a}$. Consequently, the yarn tension of the portion $Y_{1b}$ of the thread $Y_1$ between the cut-out groove 2 of the bobbin holder 1 and the cut-out edge 39*a* of the thread holding guide 39 is increased and the thread $Y_1$ is finally broken within the portion $Y_{1b}$. One of the separated portions of the thread $Y_1$, which is connected to the thread portion $Y_{1b}$, is sucked into the aspirator 14, while the helical $Y_{1a}$ separated from the thread portion $Y_{1b}$ moves to the bunch winding $B_1$ under a condition similar to the second embodiment shown in FIGS. 8A to 9B, and; finally, the portion of the thread $Y_1$ which previously formed the helical winding $Y_{1a}$ is held on the fresh bobbin 3a by an additional bunch winding, as shown in FIGS. 18A and 18B. Consequently, such undesirable condition, that the helical winding $Y_{1a}$ is retained on the fresh bobbin 3a at a position outside the bunch winding $B_1$, can be perfectly prevented. During experimental tests conducted by the inventors of the present invention it was confirmed that when the bunch winding $B_1$ is formed on the fresh bobbin 3a, due to the fact that the thread $Y_1$ runs from the thread guide 7a via the thread guide 41, after the thread $Y_1$ is caught by the cut-out groove 2 of the bobbin holder 1, the thread rapidly moves to the fresh bobbin 3a so that the number of helical windings of the thread $Y_1$ on the fresh bobbin 3a is very small. Accordingly, troubles caused by the winding of the helical winding $Y_{1a}$ about the friction roller 4 or possible breakage of the thread $Y_1$ or $Y_2$ created by entanglement of the helical winding $Y_{1a}$ with the thread $Y_1$ or $Y_2$ coming from the thread guides 7a, 7b can be perfectly prevented.

6. After the helical winding $Y_{1a}$ is held on the fresh bobbin 3a by the bunch winding $B_1$, the thread holding guide 15 further descends to a position where the thread $Y_2$ is capable of being caught by the cut-out groove 2 of the bobbin holder 1, as shown in FIGS. 18A and 18B.

Figure 19A:
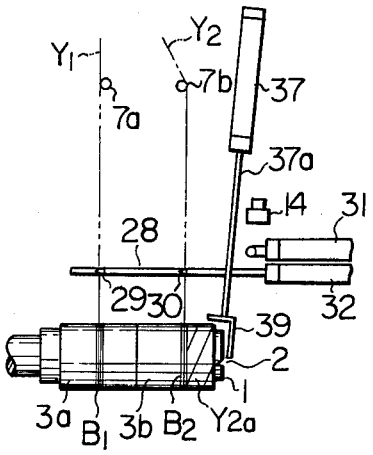
Figure 19B:
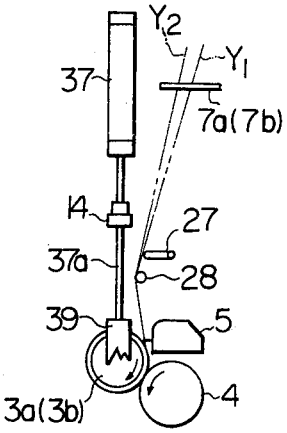

7. In this condition, the thread $Y_2$ is wound on the fresh bobbin 3b so that helical windings are formed on the bobbin 3b, and the introducing point of the thread $Y_2$ to the bobbin 3b moves to a central portion of the bobbin 3b. When the introducing point of the thread $Y_2$ to the bobbin 3b reaches the central portion of the bobbin 3b, a bunch winding $B_2$ starts to form at this portion. When the bunch winding $B_2$ is firmly formed on the fresh bobbin 3b, the thread $Y_2$ is broken at a position adjacent to the cut-out groove 2 of the bobbin holder 1, for the same reason as the breakage of the thread $Y_1$, as shown in FIGS. 19A and 19B. After that the helical winding $Y_{2a}$ moves to the bunch winding $B_2$ and is held by the bunch winding $B_2$ in the same manner as described above with regard to the helical winding $Y_{1a}$ and the bunch winding $B_1$. Since the number of the helical windings $Y_{2a}$ is quite small, the troubles discussed in the case of the helical windings $Y_{1a}$ do not exist.

Figure 20A:
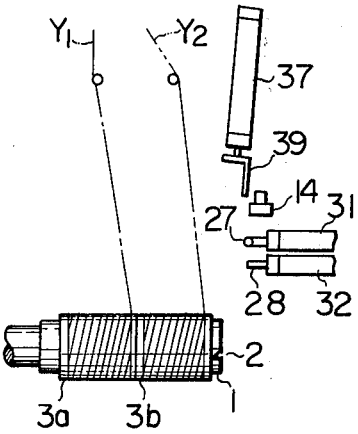
FIGS. 20A and 20B are schematic front and side views of a bobbin holder of the takeup unit and winding forming device shown in FIGS. 10A and 10B, after completion of the forming of the bunch winding on each fresh bobbin mounted on a bobbin folder and the forming of a first winding layer of a thread for forming a yarn package on each bobbin.
Figure 20B:
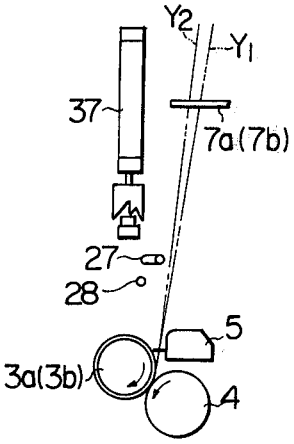

8. Upon displacing the thread takeoff guide 28 to its standby position, the threads $Y_1$ and $Y_2$ are caught by the respective traverse guides 6a and 6b, so that the normal traverse motions of the threads $Y_1$ and $Y_2$ are commenced. In addition the thread holding guide 15 is displaced to its standby position simultaneously with the above-mentioned displacement of the thread takeoff guide 28. Therefore, the normal takeup operation is commenced as shown in FIGS. 20A and 20B.

The above-mentioned sequential motions of the thread guides 26, thread takeoff guides 28, thread holding guide 15, aspirator and other related members for carrying out the method for forming the bunch winding on each of two fresh bobbins 3a, 3b mounted on the bobbin holder 1, are controlled by a programing control mechanism as hereinafter explained in detail.

Figure 21:
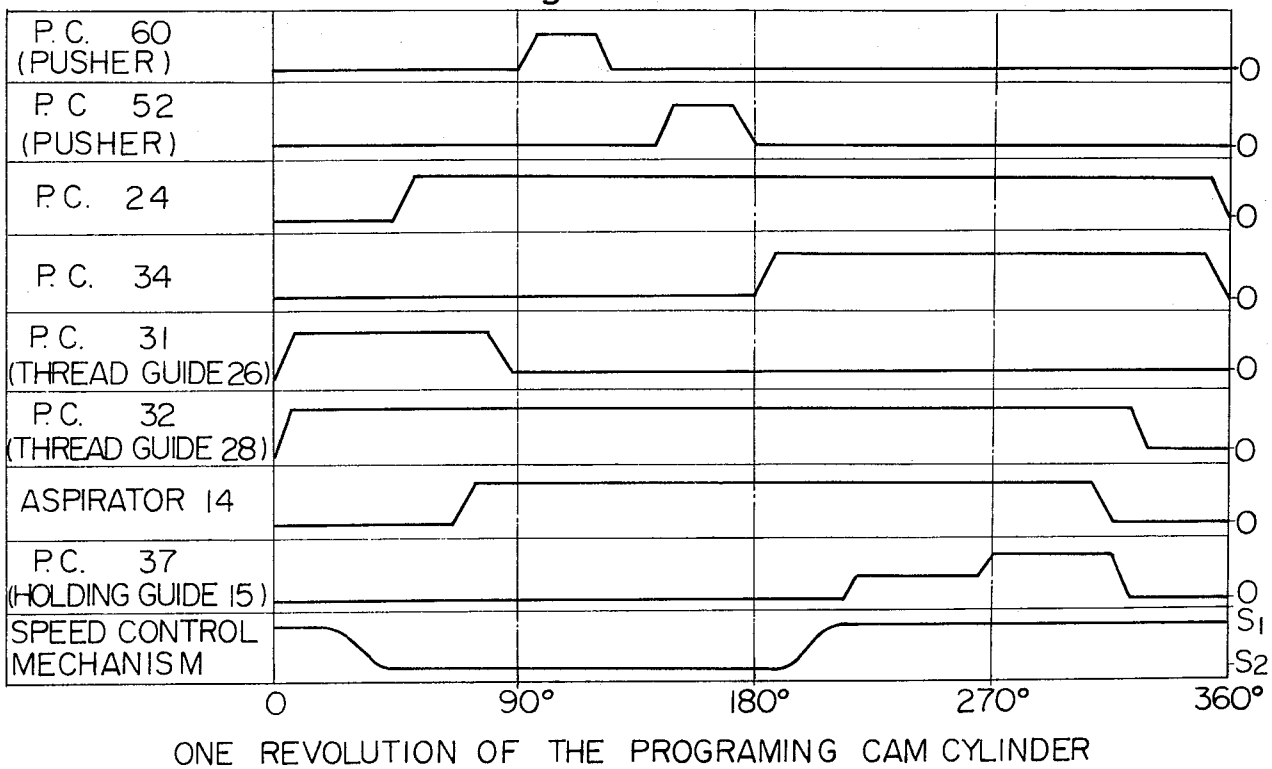
FIG. 21 is programming control chart of the elements of the doffing and donning apparatus and the bunch winding forming device shown in FIGS. 10A and 10B.
Figure 22:
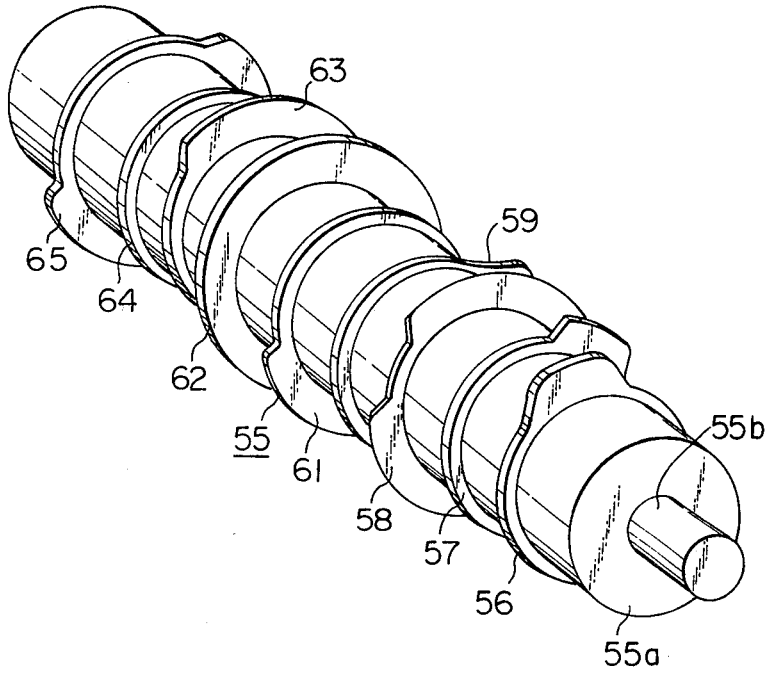
FIG. 22 is a perspective view of a programming control cylinder provided with a function characterized by the control charts shown in FIG. 21.

Referring to FIG. 22, the programing control mechanism comprises: a control cam cylinder 55, provided with a plurality of control cams 56, 57, 58, 59, 61, 62, 63, 64 and 65 coaxially mounted on a base cylinder 55a thereof; nine limit switches (not shown), which are capable of being actuated by the corresponding one of the above-mentioned control cams, and; seven three-way change valves $X_1$, $X_2$, $X_3$, $X_4$, $X_5$, $X_6$ and $X_7$ (not shown) magnetically controlled by an electric signal issued fromt the corresponding limit switches, respectively. The three-way change valve $X_1$ (not shown) is capable of actuating the pneumatic cylinder 31; the three-way change valve $X_2$ (not shown) is capable of actuating the pneumatic cylinder 32; the three-way change valve $X_3$ (not shown) is capable of actuating the pneumatic cylinder 60; the three-way change valve $X_4$ (not shown) is capable of actuating the pneumatic cylinder 52; the three-way change valve $X_5$ (not shown) is capable of actuating the pneumatic cylinder 24; the three-way change valve $X_6$ (not shown) is capable of actuating the pneumatic cylinder 34, and; the three-way change valve $X_7$ (not shown) is capable of actuating the pneumatic cylinder 37. Each of these three-way control valves is provided with an inlet conduit connected to a compressed air supply source, a first outlet conduit connected to a first chamber of the corresponding pneumatic cylinder for pushing a piston rod of the pneumatic cylinder outward and a second outlet conduit connected to a second chamber of the same pneumatic cylinder for retracting the piston rod into the cylinder. Consequently, the pushing out motion and retracting motion of the piston rod can be carried out by connecting the inlet conduit with the first outlet conduit and the second outlet conduit, respectively, of the three-way control valve by actuating the magent of the three-way control valve. The conditions of these pneumatic cylinders 31, 32, 60, 52, 24, 34, 37 during the one revolution of the corresponding cams 61, 62, 56, 57, 58, 59, 64 are shown in FIG. 21, wherein the base lines 0 represents the condition of holding the corresponding piston rod at its retracted position, and the uppermost horizontal line P represents the condition of holding the corresponding piston rod at its projected position. Concerning the programing control diagram of the pneumatic cylinder 37, $P_1$ represents a first condition of projecting the piston rod of the pneumatic cylinder 37 at a first position and $P_2$ represents a second condition of projecting the piston rod of the pneumatic cylinder 37 at a second position adjacently outside the first position. Such two-step motion is attained by utilizing a stopper (not shown) which is capable of temporarily stopping the free displacement of the piston rod from the first position to the second position. For example, a stopper (not shown) is disposed at a position adjacent to the displacing passage of the piston rod (not shown). This stopper is connected to a piston rod of a pneumatic cylinder (not shown) which is controlled by a programing cam (not shown), mounted on the cam cylinder 56, via a three-way control valve provided with a mechanism similar to the above-mentioned three-way control valves $X_1$ through $X_7$. The stopper is so positioned that it is capable of projecting into the above-mentioned displacing passage to prevent the further displacement of the piston rod of the pneumatic cylinder 37 from the first position to the second position and, thereafter, when the stopper is retracted from the above-mentioned displacing passage, the piston rod of the pneumatic cylinder 37 is displaced to the second position.

The aspirator 37 is controlled by the control cam 63 via an on-off control valve $X_8$ (not shown) which is capable of being magnetically controlled by a control signal from a limit switch (not shown) which is controlled by the cam 63. The above-mentioned on-off control valve $X_8$ is provided with an inlet conduit connected to a suction source and an outlet conduit connected to the aspirator 14. When the limit switch (not shown) issues a signal, the on-off control valve is magnetically actuated so that the inlet conduit and the outlet conduit are connected and, as a result, the aspirator 14 sucks air.

In this embodiment, the doffing and donning operations are carried out at a predetermined lower speed $S_2$ of the friction roller 4 than the normal running speed $S_1$ thereof. Such change of running speed of the friction roller 4 is controlled by the programing control cam 65 mounted on the control cam cylinder 55. A limit switch (not shown) is disposed at a position where the limit switch is capable of being actuated. The signal of the limit switch is transmitted to a conventional speed control mechanism (not shown) which receives an input of a constant driving speed and has a two-step output of running speeds, which correspond to the above-mentioned speeds $S_1$ and $S_2$. In FIG. 21, the programing of changing the output of the speed control mechanism during one revolution of the control cylinder 56 is shown.

In the above-mentioned embodiment, the thread guide 41 is rigidly mounted on the machine frame $U_0$, however, a thread guide horizontally displaceable from the machine frame $U_0$ by means of a pneumatic cylinder, or a stationary or displaceable thread guide mounted on the automatic doffing and donning apparatus 20, may be utilized instead of the thread guide 41.

The above-mentioned principle for separately forming a bunch winding on a each of a pair of fresh bobbins mounted on an identical bobbin holder can be applied for separately forming a bunch winding on each of a plurality of fresh bobbins mounted on an identical bobbin holder. For example, if three bobbins are mounted on an identical bobbin holder and it is required to form a bunch winding on each bobbin, it is required to introduce three threads supplied from the respective supply sources via separate thread guides to an aspirator by three different introducing angles so as to provide a condition wherein these three threads are capable of being caught by the cut-out groove formed at a free end of the bobbin holder, separately in sequential order. To create the above-mentioned function, in the above-mentioned embodiment, two thread guides which correspond to the thread guide 41 arranged at different levels, a thread takeoff guide 28 provided with three cut-out grooves instead of the cut-out grooves 29 and 30, a thread holding guide 15 provided with three cut-out edges formed at different levels, a three-step descending motion of the thread holding guide 15, and related control machanisms are at least needed.

In the above-mentioned embodiment for making the bunch winding on each fresh bobbin 3*a*, 3*b* mounted on the bobbin holder 1, when the thread $Y_1$ is caught by the cut-out groove 2 of the bobbin holder 1, the helical winding $Y_{1a}$ is formed from the free end of the bobbin holder 1 toward the frame side portion of the bobbin holder 1 on the fresh bobbin 3*a* continuously, and; then, the bunch winding $B_1$ is formed on the fresh bobbin 3*a*. When the bunch winding $B_1$ is formed tightly the fresh bobbin 3*a*, the portion $Y_{1b}$ of the thread $Y_1$ between the cut-out groove 2 of the bobbin holder 1 and the aspirator 14 is broken according to the increase of the yarn tension. However, if the cut-out groove 2 of the bobbin holder 1 is provided with a sharp knife edge portion for cutting the thread $Y_1$, when the portion $Y_{1b}$ contacts this knife edge portion, the elimination of the helical winding from the portion of the bobbin 3*a* on the outer side the bunch winding $B_1$ is attained in a similar manner to the above-mentioned embodiment wherein the portion $Y_{1b}$ of the thread $Y_1$ is broken by increasing the tension thereof. Further, if the cut-out groove 2 of the bobbin holder 1 is a very thin groove which is only capable of catching the thread $Y_1$, the thread $Y_1$ is released from the cut-out groove 2 of the bobbin holder 1 when the tension of the portion $Y_{1b}$ is increased. In this condition, the elimination of the helical winding from the outside portion of the bunch winding $B_1$ is attained in the same condition as the basic method explained with reference to FIGS. 1A through 6B. The same result as with the thread $Y_1$ is attained for the thread $Y_2$. The following modified method and device for foming a bunch winding on each fresh bobbin mounted on an identical bobbin holder is also applicable to attain the purpose of the present invention.

Referring to the attached drawings from FIG. 23A to FIG. 34B, wherein a bobbin holder of a takeup unit and elements of the bunch winding forming device mounted on an automatic doffing and donning apparatus are schematically shown, a modified method for forming a bunch winding on each of a pair of fresh bobbins mounted on an identical bobbin holder will now be explained in detail. Since the main construction of this device is quite similar to the bunch winding forming device shown in FIGS. 10A and 10B, the elements identical to the device shown in FIGS. 10A and 10B are represented by identical reference numerals, respectively, and the explanations thereof are omitted. The above-mentioned bunch winding forming method is carried out as follows.

Figure 23A:
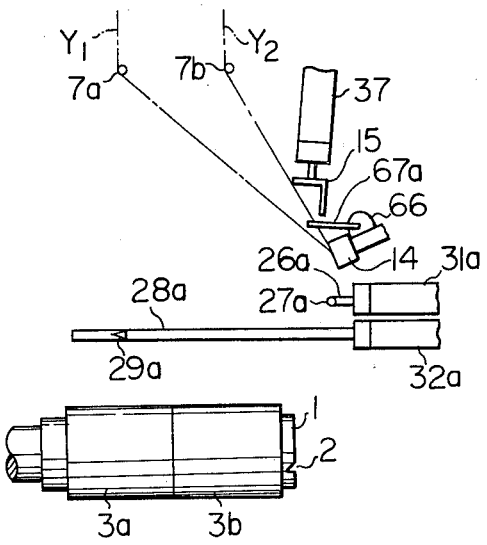
FIGS. 23A, 24A, 25A, 26A, 27A, 28A, 29A, 30A, 31A, 32A and 33A are schematic front views of a bobbin holder of a conventional takeup unit and a modified bunch winding device according to the present invention, which represent sequential steps for forming a bunch winding on each fresh bobbin mounted on the bobbin holder.
Figure 23B:
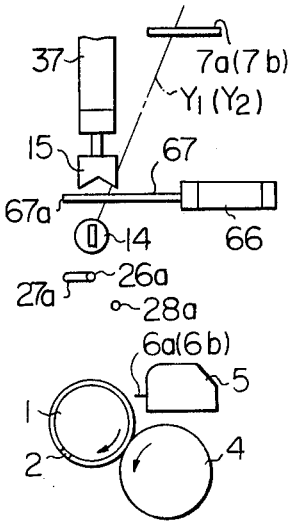
FIGS. 23B, 24B, 25B, 26B, 27B, 28B, 29B, 30B, 31B, 32B and 33B are schematic side views corresponding to FIGS. 23A, 24A, 25A, 26A, 27A, 28A, 29A, 31A, 32A and 33A, respectively.

1. When the yarn packages formed on the respective bobbins 3*a*, 3*b* become a predetermined full size, the thread takeoff guide 28*a* is projected toward the lengthwise direction of the traverse box 5. Thereafter, the bracket (not shown) supporting the pneumatic cylinders 31*a* and 32*a* is displaced toward a direction perpendicular to the traverse box 5 so as to takeoff the threads $Y_1$, $Y_2$ from the respective traverse guides 6*a*, 6*b*. Then, the threads $Y_1$, $Y_2$ coming from the respective thread guides 7*a*, 7*b* are introduced into the aspirator 14 by an introducing thread guide (not shown), the displacing motion of which is controlled by a programing control cam (not shown) mounted on a control cylinder similar to the control cylinder 55 shown in FIG. 22. These threads $Y_1$ and $Y_2$ between the aspirator 14 and the respective yarn packages on the bobbins 3*a*, 3*b* are cut by a cutter (not shown) and, thereafter, the full yarn packages are doffed and a pair of fresh bobbins 3*a*, 3*b* are mounted on the bobbin holder 1 as shown in FIGS. 23A and 23B. As shown in these drawings FIG. 23A through FIG. 34B, an additional pneumatic cylinder 66 is horizontally disposed at a position above the pneumatic cylinder 31*a* in such a condition that the piston stroke direction of the pneumatic cylinder 66 is perpendicular to the piston stroke direction of the pneumatic cylinders 31*a* and 32*a*, and a piston rod 67 of the pneumatic cylinder 66 is provided with a hook 67*a* formed at the free end thereof. The function of this hook 67*a* and the pneumatic cylinder 66 are explained hereinafter.

Figure 24A:
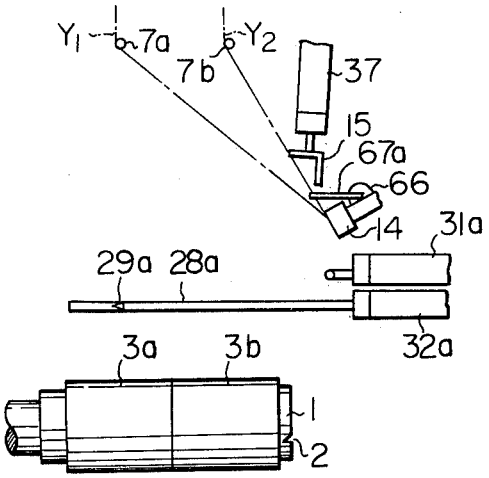
Figure 24B:
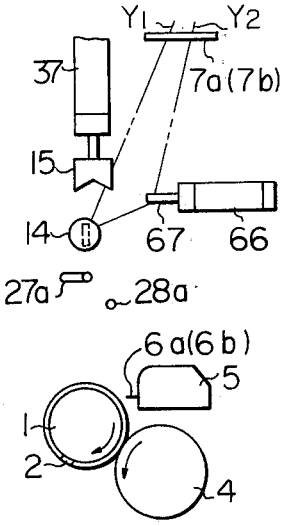

2. Next, the pneumatic cylinder 66 is actuated so as to retract the hook 67*a* in a space between the thread holding guide 15 and the aspirator. As a result, the hook 67*a* firstly catches the thread $Y_2$ and then forms a passage of the thread $Y_2$ at a position outside a descending passage of the thread holding guide 15 as shown in FIGS. 24A and 24B.

Figure 25A:
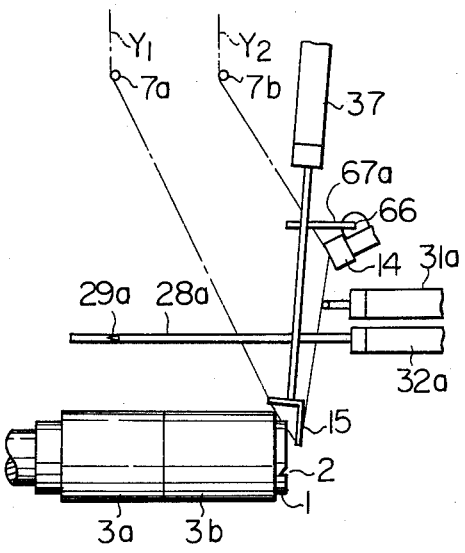
Figure 25B:
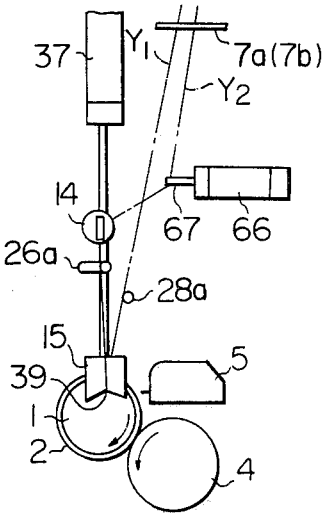

3. In such a condition, the pneumatic cylinder 37 is actuated so as to displace the thread holding guide 15 to a position adjacent to the free edge of the bobbin holder 1 so that the thread $Y_1$ between the thread guide 7*a* and the aspirator 14 is introduced into a cut-out edge 39 of the guide 15. As a result, the portion of the thread $Y_1$ between the cut-out edge 39 of the guide 15 and the thread guide 7*a* comes into contact with the free end of the bobbin holder 1, so that thread $Y_1$ is introduced into the cut-out groove 2 of the bobbin holder 1 when the guide 15 reaches to the above-mentioned position adjacent to the free edge of the bobbin holder 1. This condition is shown in FIGS. 25A and 25B.

Figure 26A:
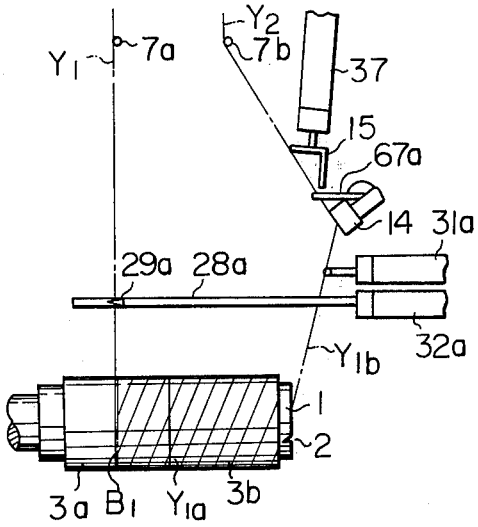
Figure 26B:
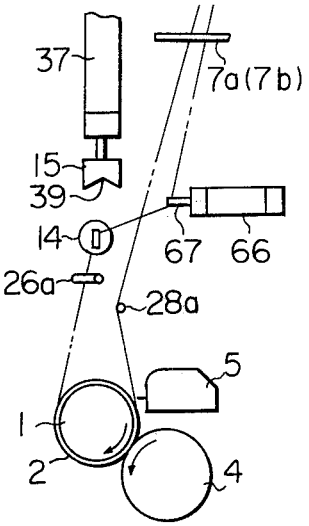

4. When the thread $Y_1$ is caught by the cut-out groove 2 of the bobbin holder 1, a helical winding $Y_{1a}$ is firstly formed on the fresh bobbin 3*b* and then continuously formed on the fresh bobbin 3*a*. Finally, the bunch winding $B_1$ is formed on the fresh bobbin 3*a* in such a condition that the thread $Y_1$ coming from the thread guide 7*a* passes through the cut-out groove 29*a* of the thread takeoff guide 28*a* as explained in the previous embodiment with reference to FIGS. 10A and 10B. During the formation of the helical winding $Y_{1a}$ and the bunch winding $B_1$, the portion $Y_{1b}$ of the thread $Y_1$ from the cut-out groove 2 of the free end of the bobbin holder 1 is continuously connected to the aspirator 14 by the suction force thereof, the thread $Y_2$ is also continuously introduced into the aspirator 14 via the hook 67*a* and the thread holding device 15 is returned to its standby position by actuating the pneumatic cylinder 37. This condition is shown in FIGS. 26A and 26B.

Figure 27A:
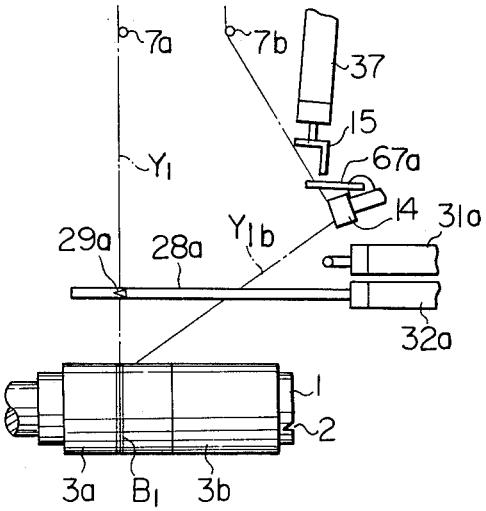
Figure 27B:
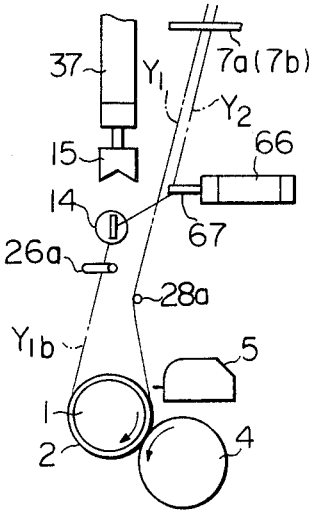

5. Since the cut-out groove 2 of the bobbin holder 1 is not provided with a sharp edge, when the bunch winding $B_1$ is firmly formed on the fresh bobbin 3*a*, the helical winding $Y_{1a}$ is tightened on the bobbin 3*a* so that the tension of the thread portion $Y_{1b}$ is increased. When the tension of the thread portion $Y_{1b}$ is increased, the portion $Y_{1b}$ is released from the cut-out groove 2 of the bobbin holder 1 and, consequently, the helical winding $Y_{1a}$ is unwound because of the rotation of the bobbin holder 1 toward a direction shown in FIG. 27B. Since the aspirator 14 always sucks in air, the above-mentioned unwound portion of the helical winding $Y_{1a}$ is sucked into the aspirator 14 and, finally, the thread portion $Y_{1b}$ extends between the bunch winding $B_1$ and the aspirator 14. In this condition, the thread $Y_2$ is continuously sucked into the aspirator 14. This condition is shown in FIGS. 27A and 27B.

Figure 28A:
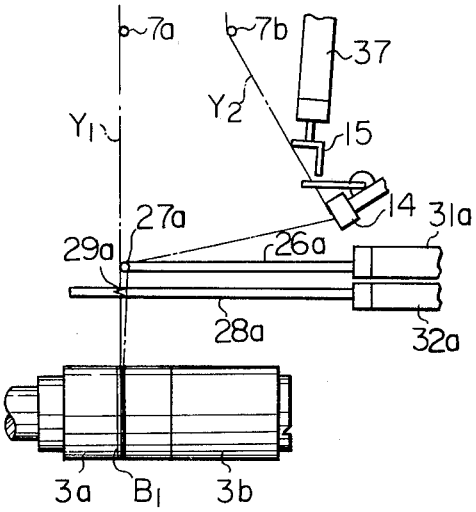
Figure 28B:
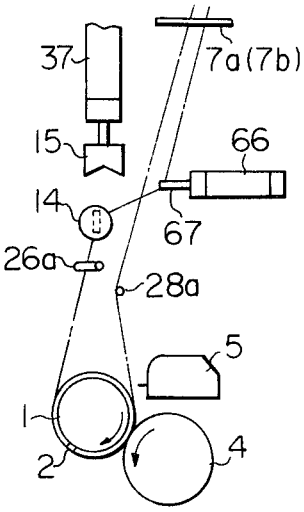

6. Next, the pneumatic cylinder 31*a* is actuated so as to project the thread cutting guide 26*a* outward along the displacing passage parallel to the thread takeoff guide 28*a*. According to this motion of the guide 26*a*, the thread portion $Y_{1b}$ is caught by the hook 27*a* of the guide 26*a* and the passage of the thread portion $Y_{1b}$ is deformed as shown in FIGS. 28A and 28B. The terminal of the above-mentioned outward displacing motion of the guide 26*a* is fixed at a position where the hook 27*a* is positioned adjacent to the passage of the thread $Y_1$ between the guide 7*a* and the bunch winding $B_1$. Consequently, when the tension of the thread portion $Y_{1b}$ is increased according to the further rotation of the bobbin holder 1, after firmly forming the bunch winding on the fresh bobbin 3*a*, the thread portion $Y_{1b}$ is broken by the excess tension and the broken end connected to the bunch winding $B_1$ is held by an additional bunch winding on the bobbin 3*a*, while the other broken end of the thread portion $Y_{1b}$ is sucked into the aspirator 14.

Figure 29A:
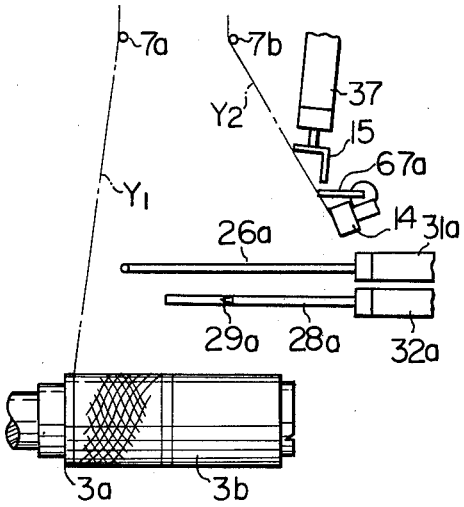
Figure 29B:
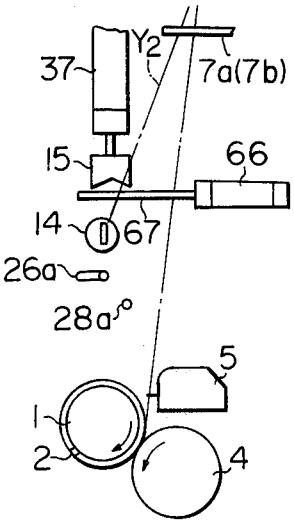

7. In the above-mentioned condition, the pneumatic cylinder 32*a* is actuated so as to retract the thread takeoff guide 28*a* to a position where the cut-out groove 29*a* thereof is located at a working position with regard to the fresh bobbin 3*a*. In this condition, the thread $Y_1$ is released from the cut-out groove 29*a* and is caught by the traverse guide 6*a* so that the normal traverse motion of the thread $Y_1$ is commenced for making a yarn package on the bobbin 3*a*, while the thread $Y_2$ is continuously sucked into the aspirator 14. This condition is shown in FIGS. 29A and 29B.

Figure 30A:
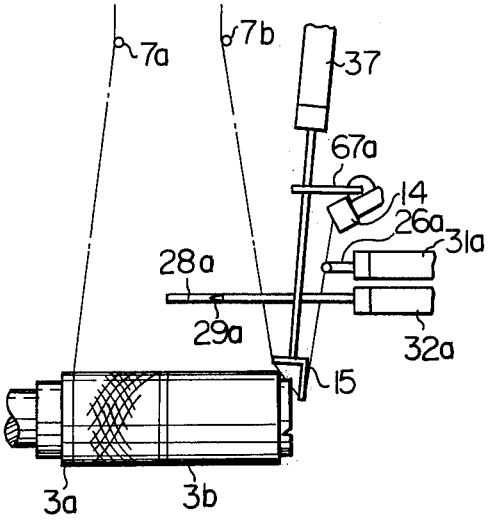
Figure 30B:
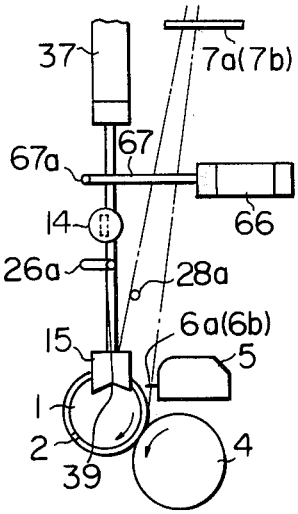
Figure 31A:
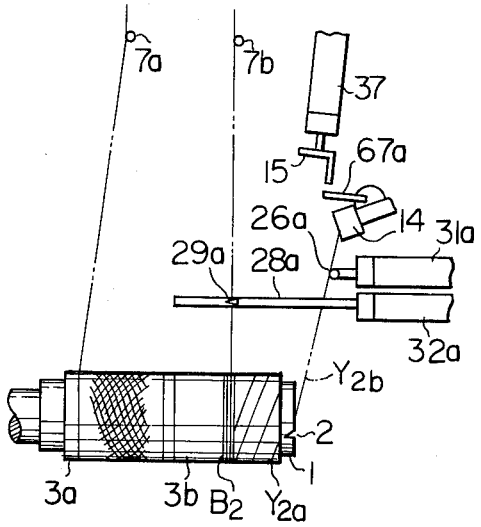
Figure 31B:
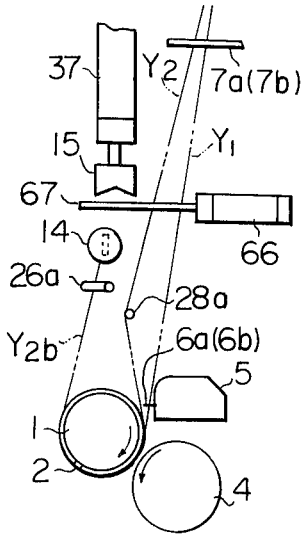
Figure 32A:
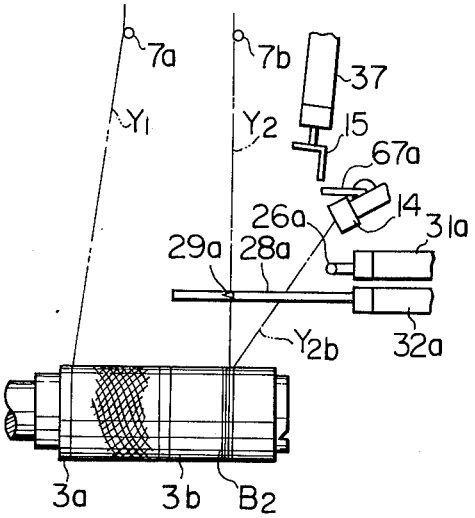
Figure 32B:
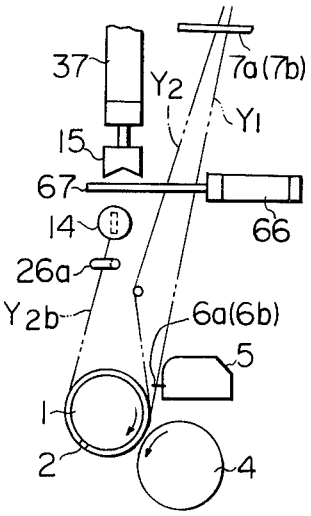

8. Next, the pneumatic cylinder 66 is actuated so as to project the piston rod 67 outward and to release the thread $Y_2$ from the hook 67*a*. In this condition, the pneumatic cylinder 37 is actuated so as to descend the thread holding guide 15 to the position adjacent to the free end of the bobbin holder I. According to this descending motion of the thread holding guide 15, the thread $Y_2$ is caught by the cut-out edge 39 of the guide so that the portion of the thread $Y_2$ between the cut-out groove 39 and the thread guide 7*b* contacts the free end of the bobbin holder 1 and is caught by the cut-out groove 2. During this time, the normal takeup motion by the bobbin 3*a* is being carried out. This condition is shown in FIGS. 30A and 30B.

9. The formation of the helical winding $Y_{2a}$ and the bunch winding $B_2$ on the fresh bobbin 3*b* and the releasing of the thread $Y_2$ from the cut-out groove 2 of the bobbin holder 1, so as to eliminate the helical winding $Y_{2a}$ and firmly form the bunch winding $B_2$ on the bobbin 3*b*, are carried out under conditions similar to the case of the thread $Y_1$. These conditions are shown in FIGS. 31A, 31B and 32A, 32B, respectively.

Figure 33A:
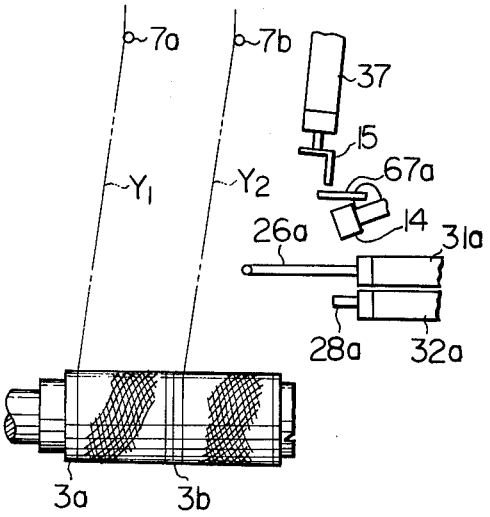
Figure 33B:
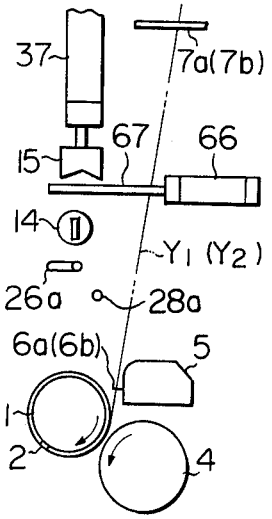

10. When the bunch winding $B_2$ is firmly formed on the bobbin 3*b* and the helical winding $Y_{2a}$ is eliminated, the tension of the thread $Y_{2b}$ between the bunch winding $B_2$ and the aspirator 14 is increased by further rotation of the bobbin holder 1 and, consequently, this thread portion $Y_{2b}$ is broken by the excess tension. In this condition, when the pneumatic cylinder 32*a* is actuated so as to retract the thread takeoff guide 28*a* to its standby position, the thread $Y_2$ coming from the thread guide 7*b* to the bunch winding $B_2$ is released from the cut-out groove 29*a* of the thread takeoff guide 28*a* so that the thread $Y_2$ is caught by the traverse guide 6*b*. Consequently, the normal traverse motion of the thread $Y_2$ by the traverse guide 6*b* is commenced. This condition is shown in FIGS. 33A and 33B.

Figure 34A:
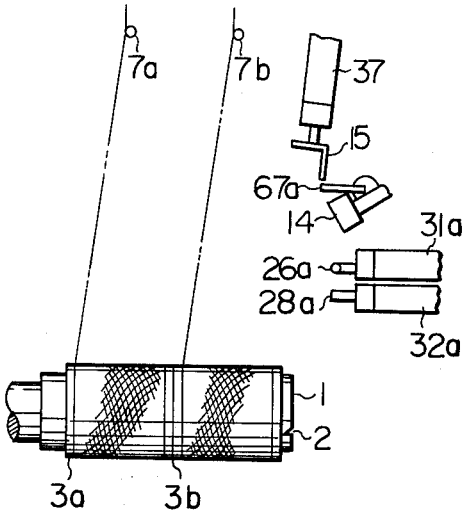
FIGS. 34A and 34B are schematic front and side views, respectively of a bobbin holder of the takeup unit and the modified bunch winding forming device shown in FIGS. 23A through 33B, after completion of the forming of the bunch winding on each fresh bobbin mounted on the bobbin holder and the forming of a first winding layer of a thread for forming a yarn package on each bobbin.
Figure 34B:
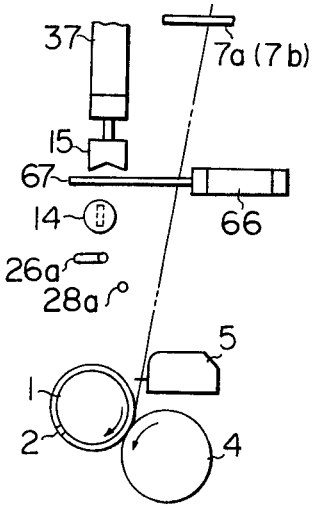

11. Next, the pneumatic cylinder 31*a* is actuated so as to retract the guide 26*a* to its standby position. In this condition, the normal takeup operations are commenced to the fresh bobbins 3*a* and 3*b* as shown in FIGS. 34A and 34B.

In the above-mentioned embodiment, the thread guides 7*a* and 7*b* are stationarily disposed and the threads $Y_1$ and $Y_2$ are introduced to the aspirator 14 directly from the thread guides 7*a*, 7*b* by means of an additional moving thread guide. However it is also applicable to utilize intermediate thread guides which are movably disposed in the respective spaces between each of the above-mentioned thread guides 7*a*, 7*b* and the aspirator 14.

What is claimed is:

1. In a method of forming a bunch winding on each fresh bobbin mounted on a bobbin holder rotatably mounted on a takeup unit provided with a traverse guide disposed at a position corresponding to each fresh bobbin at the time of carrying out a doffing and donning operation, wherein a supplying thread via a thread guide disposed above said corresponding thread guide is firstly introduced into an aspirator disposed at an outside position of said bobbin holder, when a yarn package formed on said bobbin mounted on said bobbin holder becomes a predetermined full size, next a thread portion between said full size yarn package and said aspirator is cut, and thereafter said full size yarn package is doffed from said bobbin holder and a fresh bobbin is mounted on said bobbin holder at the position where said full yarn package was doffed said bunch winding forming method comprising:

1. a step of introducing a portion of a supplying thread via said thread guide into said aspirator to a position adjacent to a free end of said bobbin holder where said thread portion is capable of contacting said free end of said bobbin holder;
2. a step of catching a part of said thread portion by said free end of said bobbin holder;
3. a step of displacing the point of introduction of said supplying thread onto said bobbin from said free end of said bobbin holder to a particular position where the distance between said thread guide and said fresh bobbin is minimum so that a helical winding is formed on said fresh bobbin;
4. a step of forming an initial portion of a bunch winding on said fresh bobbin at said particular position;
5. a step of eliminating said helical winding after an initial portion of said bunch winding is firmly formed;
6. a step of forming the remainder of said bunch winding; and
7. a step of commencing a normal traverse motion of said supplying thread with respect to said fresh bobbin after completion of forming an entire portion of said bunch winding.

2. A method of forming a bunch winding on a fresh bobbin mounted on a bobbin holder of a takeup unit according to claim 1, wherein said step of eliminating said helical winding is carried out by following the steps of:

1. releasing said caught part of said thread portion from said free end of said bobbin holder;
2. unwinding said helical winding from said bobbin by continuously rotating said bobbin holder and sucking the thread of said helical winding into said aspirator simultaneously with the unwinding said helical winding;
3. increasing the tension of a thread portion connected between said initially formed bunch winding formed before said unwinding of said helical winding and said aspirator, after said unwinding of helical winding is completed, by further rotating said bobbin holder, so that said connected thread portion is broken;
4. sucking one broken portion of said connected thread portion into said aspirator while holding the other broken portion of said connected thread portion by an additional bunch winding on said initially formed bunch winding on said fresh bobbin.

3. A method of forming a bunch winding on a fresh bobbin mounted on a bobbin holder of a takeup unit according to claim 1, wherein said step of eliminating said helical winding is carried out by the steps of:

1. increasing the tension of said thread portion between said free end of said bobbin holder and said aspirator when said initially formed bunch winding is firmly formed on said fresh bobbin by further rotating said fresh bobbin, so that said thread portion is broken by excess tension;
2. sucking one broken portion of said thread portion into said aspirator while lossening said helical winding connected to the other broken portion of said thread portion and displacing said loosened helical winding toward said initially formed bunch winding;
3. holding said displaced loosened helical winding by an additional bunch winding on said initially formed bunch winding formed on said fresh bobbin.

4. A method of forming a bunch winding on a fresh bobbin mounted on a bobbin holder of a takeup unit according to claim 3, wherein said step of breaking said thread portion between said free end of said bobbin holder and said aspirator is positively created by cutting said thread portion with a sharp knife edge on a portion of said free end of said bobbin holder where said thread portion between said thread guide and said aspirator is caught.

5. A method of forming a bunch winding on each fresh bobbin mounted on a bobbin holder according to claim 1, wherein said takeup unit is provided with a plurality of thread guides mounted thereon for forming the same number of yarn packages as the number of said traverse guides on the respective fresh bobbins mounted on said bobbin holder, a thread guide is disposed at a position above each of said traverse guides, said bunch winding forming operation is carried out in sequential steps from a first fresh bobbin mounted on a position of said bobbin holder farthest from said free end of said bobbin holder to a last fresh bobbin mounted on a position of said bobbin holder closest to said free end of said bobbin holder in such a condition that between said thread guides and said aspirator the supplying thread or threads not at that time to be subjected to said bunch winding forming step are positively separated from the supplying thread which is at that time to be subjected to said bunch winding step by being introduced to a position adjacent to said free end of said bobbin holder.

6. A method of forming a bunch winding on each fresh bobbin mounted on a bobbin holder according to claim 5, wherein said positive separation of said supplying thread or threads not at that time to be subjected to said bunch winding forming step by being introduced to a position adjacent to said free end of said bobbin holder is carried out by positively changing the respective introducing angles of all said supplying threads into said aspirator when all supplying threads via the respective thread guides are introduced into said aspirator before carrying out said doffing operation.

7. A method for forming a bunch winding on each fresh bobbin mounted on a bobbin holder according to claim 5, wherein said positive separation of said supplying thread or threads not at that time to be subjected to said bunch winding forming step by being introduced to a position adjacent to said free end of said bobbin holder is carried out by positively displacing said supplying thread or threads from a passage for introducing the supplying thread which is to be subjected to said bunch winding forming step away from said position adjacent to said free end of said bobbin holder for catching.

8. A device for forming a bunch winding, at a time of carrying out a doffing and donning operation, on each fresh bobbin mounted on a bobbin holder rotatably mounted on a takeup unit provided with a traverse guide disposed at a position corresponding to each fresh bobbin and a thread guide disposed above said traverse guide, comprising incorporated with a doffing and donning apparatus, an aspirator disposed at a position outside and above said bobbin holder for sucking a supplying thread coming from said thread guide, a displaceable thread guide for introducing said supplying thread into said aspirator before carrying out said doffing operation, said bobbin holder being provided with a cut-out groove formed at a free end thereof, means for introducing a portion of said supplying thread between said thread guide and said aspirator to a position adjacent to said cut-out groove where said thread portion is capable of being caught by said cut-out groove, a first actuating means for displacing said aspirator between a first position adjacent said displaceable thread guide and a second position adjacent said cut-out groove, a second actuating means for actuating said displaceable thread guide, a third actuating means for actuating said introducing means, a programing control mechanism for sequentially actuating said first, second and third means in combination for actuating said doffing and donning apparatus.

9. A device for forming a bunch winding on each fresh bobbin mounted on a bobbin holder rotatably mounted on a takeup unit according to claim 8, wherein said cut-out groove is provided with a sharp knife edge for cutting a thread portion caught thereby.

10. A device for forming a bunch winding on each fresh bobbin mounted on a bobbin holder rotatably mounted on a takeup unit according to claim 8, wherein said cut-out groove is a thin recess without any sharp edge so that a thread portion caught thereby is capable of escaping therefrom when the tension of a thread portion between said cut-out groove and said aspirator is increased.

11. A device for forming a bunch winding on each fresh bobbin mounted on a bobbin holder rotatably mounted on a takeup unit according to claim 8, wherein said cut-out groove is a thick recess provided with a blunt edge so that a thread portion between said cut-out groove and said aspirator is capable of breaking when the tension of said thread portion is excessively increased.

12. A device for forming a bunch winding on each fresh bobbin mounted on a bobbin holder rotatably mounted on a takeup unit according to claim 8, wherein said first, second and third actuating means are pneumatic cylinders connected to a compressed air supply source via respective magnetically controlled valves, said programing control mechanism comprises a control cam cylinder provided with a plurality of programing cams coaxially mounted thereon and a plurality of limit switches which are capable of being actuated by the respective programing cams, said cams being provided with respective control cam profiles defined by the sequential control program, said limit switches being capable of actuating the corresponding control valves according to control signals issued when said limit switches are actuated by the respective control cams.

13. A device for forming a bunch winding on each fresh bobbin mounted on a bobbin holder rotatably mounted on a takeup unit according to claim 8, wherein said introducing means is a thread holding guide provided with a cut-out edge for temporarily holding said thread portion.

14. A device for forming a bunch winding on each fresh bobbin mounted on a bobbin holder rotatably mounted on a takeup unit according to claim 8, wherein said takeup unit is provided with a plurality of thread guides mounted thereon for forming the same number of yarn packages as the number of said traverse guides on the respective fresh bobbins mounted on said bobbin holder, said thread guide is disposed at a position above each of said traverse guides, said displaceable thread guide is capable of simultaneously introducing each supplying thread via the corresponding thread guide into said aspirator, and further comprising means for separately introducing a portion of said supplying thread between said thread guide and said aspirator to a passage of said introducing means in such order that said separate introducing operation of said thread portion is carried out from a supplying thread supplied to a fresh bobbin mounted on a position of said bobbin holder farthest from said free end of said bobbin to a supplying thread supplied to a fresh bobbin mounted on a position of said bobbin holder closest to said free end of said bobbin holder, and means for actuating said separate introducing means, said actuating means being controlled by said programing control mechanism.

15. a device for forming a bunch winding on each fresh bobbin mounted on a bobbin holder rotatably mounted on a takeup unit according to claim 14, further comprising means for defining a position for forming a bunch winding on each fresh bobbin, said position defining means being controlled by said programing control mechanism.

16. A device for forming a bunch winding on each fresh bobbin mounted on a bobbin holder rotatably mounted on a takeup unit according to claim 15, wherein said position defining means is a pneumatic cylinder and a piston rod which is capable of displacing along a passage above and parallel to said bobbin holder, said piston rod being provided with cut-out grooves for receiving corresponding supplying threads coming from the respective thread guides when the bunch windings are forming on the respective fresh bobbins.

17. A device for forming a bunch winding on each fresh bobbin mounted on a bobbin holder rotatably mounted on a takeup unit according to claim 8, further comprising: a displaceable frame for supporting said device, said frame displaceably mounted on said doffing and donning apparatus in such a condition that after actuating a preparatory motion of said displaceable thread guide in a space behind the passages of said supplying threads toward the respective traverse guides in order to displace said displaceable thread guide at a position for catching said supplying threads thereby, said supporting frame is capable of displacing said displaceable thread guide, said introducing means and said aspirator toward a direction away from said traverse guides, and; means for actuating said displaceable frame, said actuating means being controlled by said programing control mechanism.

18. A device for forming a bunch winding on each fresh bobbin mounted on a bobbin holder rotatably mounted on a takeup unit according to claim 14, wherein said separate introducing means comprises a stationary thread guide horizontally mounted on a machine frame of said takeup unit in parallel condition to said bobbin holder, said stationary thread guide is disposed at a position adjacently above a passage of said displaceable thread guide and is provided with a hook formed at a free end thereof, said hook is positioned in a space between a first thread passage between a first thread guide and a first bobbin mounted on a first position of said bobbin holder farthest from said free end of said bobbin holder and a second thread passage between a second thread guide and a second bobbin mounted on a second position adjacent to said first position of said bobbin holder on the side toward said free end of said bobbin holder, whereby when said displaceable thread guide is actuated so as to introduce a supplying thread running along said first and second thread passages respectively into said aspirator, the introducing angle of said two thread portions into said aspirator is changed with respect to each other; said introducing means is a thread holding plate provided with a pair of cut-out edges formed at different levels, the lower of said cut-out edges is capable of catching one of said supplying threads introduced into said aspirator while the higher of said cut-out edges is capable of catching said the other supplying thread introduced into said aspirator when said thread holding means is displaced to said position adjacent to said free end of said bobbin, whereby said two thread portions caught by the respective cut-out edges of said thread holding guide are capable of being caught by a cut-out groove of said free end of said bobbin holder in two separate stepwise displacing motion of said thread holding guide.

19. A device for forming a bunch winding on each fresh bobbin mounted on a bobbin holder rotatably mounted on a takeup unit according to claim 14, wherein said separate introducing means comprises an additional thread displacing means disposed above said displaceable guide, said additional thread displacing means comprises a pneumatic cylinder and a piston rod thereof which is displaceable along a passage perpendicular to a displacing passage of said displaceable thread guide, said piston rod provided with a hook formed at its free end, and said hook is capable of catching one of the thread portions introduced into said aspirator by means of said displaceable thread guide when said additional thread displacing means is actuated so as to separate said caught thread portion from the displacing passage of said introducing means, said pneumatic cylinder is connected to a compressed air source via a control valve which is capable of being magnetically controlled, said control valve is actuated by said programing control mechanism, whereby, one of the thread portions sucked into said aspirator can be firstly introduced to the cut-out groove of the free end of said bobbin holder while the other thread portion sucked into said aspirator is separated from the passage of said introducing means by means of said additional thread displacing means, for forming a bunch winding on the corresponding fresh bobbin mounted on said bobbin holder and, thereafter, said hook of said pneumatic cylinder is displaced to its standby position by releasing the actuation of said pneumatic cylinder, next said introducing means is actuated again so that said initially separated thread portion from the passage of said introducing means is caught by said introducing means and caught by said cut-out groove of the free end of said bobbin holder so that formation of a bunch winding on the other corresponding fresh bobbin is commenced.

* * * * *

UNITED STATES PATENT OFFICE
CERTIFICATE OF CORRECTION

Patent No. 4,069,983 Dated January 24, 1978

Inventor(s) Masahiro Muramatsu, et al

It is certified that error appears in the above-identified patent and that said Letters Patent are hereby corrected as shown below:

Column 3, line 34: "a" (1st occurrence) should be --an--.

Column 4, line 36: "FIGS." should be --FIG.--.

line 42: "FIGS." should be --FIG.--.

Column 6, line 12: "of" (2nd occurrence) should be --on--.

line 48: "nad" should be --and--.

Column 14, line 6: "fromt" should be --from--.

line 31: "magent" should be --magnet--.

Column 20, line 8: "lossening" should be --loosening--.

UNITED STATES PATENT OFFICE

CERTIFICATE OF CORRECTION

Patent No. 4,069,983 Dated January 24, 1978

Inventor(s) Masahiro Muramatsu, et al

It is certified that error appears in the above-identified patent and that said Letters Patent are hereby corrected as shown below:

Column 21, lines 19-21 should read:

--means for displacing said aspirator between a first position adjacent said cut-out groove and a second position adjacent said traverse guide, a second--.

Column 22, line 28: "a" should be --A--.

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*